US009920882B2

(12) United States Patent
Kawamura et al.

(10) Patent No.: US 9,920,882 B2
(45) Date of Patent: Mar. 20, 2018

(54) GAS CHARGING METHOD FOR A BAG EQUIPPED WITH GAS COMPARTMENT

(71) Applicant: Toyo Jidoki Co., Ltd., Minato-ku, Tokyo (JP)

(72) Inventors: Kenji Kawamura, Iwakuni (JP); Tohru Yoshikane, Iwakuni (JP)

(73) Assignee: Toyo Jidoki Co., Ltd., Minato-ku, Tokyo (JP)

( * ) Notice: Subject to any disclaimer, the term of this patent is extended or adjusted under 35 U.S.C. 154(b) by 1125 days.

(21) Appl. No.: 14/136,487

(22) Filed: Dec. 20, 2013

(65) Prior Publication Data

US 2014/0182244 A1 Jul. 3, 2014

(30) Foreign Application Priority Data

Dec. 22, 2012 (JP) ..... 2012-280371
Mar. 5, 2013 (JP) ..... 2013-042722

(51) Int. Cl.

| | |
|---|---|
| ***F17C 5/06*** | (2006.01) |
| ***B65B 31/04*** | (2006.01) |
| ***B65B 55/20*** | (2006.01) |
| ***B65B 61/00*** | (2006.01) |

(52) U.S. Cl.

CPC ..... *F17C 5/06* (2013.01); *B65B 31/048* (2013.01); *B65B 55/20* (2013.01); *B65B 61/00* (2013.01)

(58) Field of Classification Search

None

See application file for complete search history.

(56) References Cited

U.S. PATENT DOCUMENTS

| | | | | |
|---|---|---|---|---|
| 3,745,024 A * | 7/1973 | Ford | B65B 31/046 141/290 |
| 4,473,989 A * | 10/1984 | Tsutsumi | B65B 43/30 141/166 |
| 4,753,060 A * | 6/1988 | Furukawa | B65B 43/36 53/459 |
| 6,877,601 B1 * | 4/2005 | Colombo | A23L 3/3409 206/213.1 |
| 6,990,790 B2 * | 1/2006 | Yasuhira | B65B 3/18 141/65 |

(Continued)

FOREIGN PATENT DOCUMENTS

| | | |
|---|---|---|
| JP | 4771785 B | 9/2011 |
| JP | 5104073 B | 12/2012 |

*Primary Examiner* — Hemant M Desai
*Assistant Examiner* — Tanzim Imam
(74) *Attorney, Agent, or Firm* — Norton Rose Fulbright US LLP

(57) ABSTRACT

In a method and apparatus for filling a gas in a gas compartment portion of a bag, a bag-conveying gripper (41) including a pair of gripping elements (45 and 46), and the inner surface (gripping surface) of the gripping element (45) being formed with a shallow groove (47). The bag-conveying gripper (41) grips the sealed portion (12) of the bag, and a neck section (16*a*) of the gas compartment portion (16) in the sealed portion is held at a groove formed in the gripping elements of the bag-conveying gripper. Compressed gas is ejected into the gas compartment portion through incision (17) formed in the neck section, inflating the gas compartment portion 16. The inflated shape of the neck section held by the bag-conveying gripper is restricted to a flat configuration by the inner surfaces of the bag-conveying gripper.

5 Claims, 23 Drawing Sheets

(56) References Cited

U.S. PATENT DOCUMENTS

| | | | | |
|---|---|---|---|---|
| 7,389,627 | B2 * | 6/2008 | Miles | B65D 77/0413 206/524.8 |
| 7,444,795 | B2 * | 11/2008 | Yasuhira | B65B 43/465 53/133.2 |
| 2007/0089377 | A1 | 4/2007 | Yasuhira | |
| 2009/0007803 | A1 * | 1/2009 | Bergman | B65D 81/2038 99/472 |
| 2010/0133294 | A1 * | 6/2010 | Chan | B65D 83/0061 222/94 |
| 2010/0281831 | A1 * | 11/2010 | Kannankeril | B31D 5/0073 53/432 |
| 2011/0138751 | A1 * | 6/2011 | Nakagawa | B65B 43/50 53/469 |

* cited by examiner

GAS CHARGING METHOD FOR A BAG EQUIPPED WITH GAS COMPARTMENT

BACKGROUND OF THE INVENTION

1. Field of the Invention

The present invention relates to a method and apparatus for charging a gas into a bag and more particularly to a method and apparatus for charging a gas into a gas compartment provided in a sealed side edge portion of a bag.

2. Description of the Related Art

Japanese Patent No. 4,771,785 describes a method for charging a gas compartment portion of a bag with a gas in which a gas compartment of the gas compartment portion is formed integrally therewith and spaced away from the contents storing portion that stores contents for the bag.

More specifically, in this Japanese Patent No. 4,771,785, an incision or an opening used for placing the exterior of the bag in communication with the interior of the gas compartment portion is formed in the surface of the film that makes the gas compartment portion. The discharge outlet of a nozzle connected to a pressurized gas supply source is aligned with the incision or opening, with the back side of the bag being supported by a bag backing member, and gas is injected from the nozzle into the gas compartment portion of the bag through the incision or opening. While the injection is in progress, a blockage region configured in the vicinity of the incision or opening is held from both sides of the bag by a gas blocking gripper so as to block the fluid communication of gas between the incision or opening and the interior of the gas compartment portion. Then, the bag is sealed using hot plates contacted on both sides of the bag in the location of the incision or opening while the blocked state of the blockage portion is being maintained, thus sealing the incision or opening and entrapping the gas in the gas compartment portion.

In this Japanese Patent No. 4,771,785, the gas compartment portion is formed, for example, between the film sheets constituting the front and rear surfaces in the sealed side edge portion of the bag, or alternatively, if the film constituting the front and rear surfaces of the bag is a laminated film, the gas compartment portion is formed inside the laminated film at least on one side. Such a gas compartment portion can be formed not only in lay-flat bags, but also in bottom-gusseted self-supporting bags, as well as in bags provided with spouts.

If the gas compartment portion extends downwardly from the vicinity of the upper edge of the bag and the incision or opening is formed in the vicinity of the upper edge of the gas compartment portion, the gas compartment can be charged with gas by gripping, while the injection is in progress, a location below the incision or opening with a gas blocking gripper so as to block the fluid communication of gas between the incision or opening and the interior of the gas compartment portion and then completely sealing the mouth of the bag from both sides together with the incision or opening at the same time.

In Japanese Patent No. 4,771,785, the charging of the gas compartment portion with a gas can be accomplished as part of the bag packaging process (including lay-flat bags, gusseted bags, etc.).

More specifically, the bag equipped with a gas compartment is continuously or intermittently conveyed while being suspended with its two lateral edges held by grippers, and, while the bag is being conveyed, various packaging steps, including opening the mouth of the bag, filling it with the material to be packaged, sealing the mouth of the bag, etc., are consecutively carried out; and in these steps, the step of charging the gas compartment portion with a gas is carried out after the contents filling step. In this Japanese Patent No. 4,771,785, the charging of the gas compartment portion with a gas can be accomplished as part of the bag packaging process. Specifically, a bag provided with a spout is continuously or intermittently conveyed with its spout held by a bifurcate spout-holding member inserted between the top and bottom flanges formed in the spout and, while it is being conveyed, various packaging steps, including sealing the spout and the film in the mouth of the bag, sealing the two film sheets together in the mouth of the bag, filling the bag with the material to be contained therein, capping the orifice of the spout, etc., are carried out in a consecutive manner; and in these steps, the step of charging the gas compartment portion with a gas is carried out before the filling step. In either case described above, it is desirable that the sealing of the bag mouth be carried out simultaneously with the sealing of the incision or opening.

On the other hand, according to the description of Japanese Patent No. 5,104,073, an incision or an opening is made at the upper edge of a gas compartment portion formed in a sealed side edge portion of a bag, and a gas charging pathway is formed so as to extend from the incision or opening with a width thereof being narrower (smaller) than the other (or main) part of the gas compartment portion; and gas is injected through the incision or opening into the gas compartment portion, and while the injection is in progress, a location in the vicinity of (directly underneath) the incision or opening within the gas charging pathway is heat sealed, thus sealing the gas in the gas compartment portion. In the gas charging method of Japanese Patent No. 5,104,073, the step of injecting gas into the gas compartment portion and the heat sealing step are not be able to be separated; accordingly, when this method is used in, for example, an intermittently rotating rotary-type packaging apparatus, it is difficult to increase productivity in comparison with the gas charging method of Japanese Patent No. 4,771,785.

In the gas charging method described in Japanese Patent No. 4,771,785, the gas compartment portion expanded by a gas (air) is gripped by a gas blocking gripper while the gas injection into the gas compartment portion is in progress, so that the fluid communication of gas between the incision or opening and the interior of the gas compartment portion is blocked. At such time, the front and rear film sheets or laminated film of the gas compartment portion (blockage region) being gripped often do not collapse into a flat configuration; as a result, a gap is created in the gas compartment portion, thus making it impossible to completely block the fluid communication of gas between the incision or opening and the interior of the gas compartment portion. In such a case, a problem of leakage of gas from the gas compartment portion would occur after the nozzle and the bag backing member are retracted from the location of the incision or opening and before such a location of the incision or opening or a location nearby is clamped between hot plates and sealed.

This problem will be described with reference to FIGS. 22(*a*) through 23(*b*).

In FIG. 22(*a*), the reference numeral 1 designates a sealed side edge portion provided in a bag equipped with a gas compartment (see FIG. 1 in Japanese Patent No. 4,771,785), 2 designates a gas compartment portion formed vertically between the film sheets 3, 4 that constitute the front and rear surfaces of the sealed portion 1, 5, 5 designate gas blocking grippers, 6 designates a nozzle used for gas injection, and 7 designates a bag backing member.

The bag equipped with gas compartment illustrated in FIG. 22(*a*) corresponds to the bag equipped with gas compartment "1" described in Japanese Patent No. 4,771,785, and the gas compartment portion 2 corresponds to the gas compartment portion "5" (see in FIG. 1 of Japanese Patent No. 4,771,785 for both "1" and "5"), while the gas blocking gripper 5, nozzle 6, and bag backing member 7 correspond to the sub-gripper "7", nozzle "11", and bag backing member "12", respectively, of this art (see FIGS. 2-4 of Japanese Patent No. 4,771,785 for these members). The bag equipped with gas compartment illustrated in FIG. 22(*a*) has two of its lateral edges gripped by bag-conveying grippers (corresponding to the grippers "8" in Japanese Patent No. 4,771,785), which are not shown in the embodiment of FIG. 4 of this art.

FIG. 22(*b*) shows a state in which the nozzle 6 and the receiving member 7 have advanced from the retracted positions illustrated in FIG. 22(*a*), the distal end (discharge outlet) of the nozzle 6 has been aligned with the incision or opening formed in the gas compartment portion 2, the bag backing member 7, which faces the nozzle 6, supports the back of the gas compartment portion 2, and a gas is injected into the gas compartment portion 2. The gas compartment portion 2 can be freely expanded in response to the pressure of the gas, and as a result of which the edge 1*a* of the side edge portion 1 of the bag is pulled in, thus moving a distance D towards the center of the bag equipped with gas compartment.

FIG. 23(*a*) shows that gas injection through the nozzle 6 is in progress while the gripping elements of the gas blocking gripper 5 has advanced from the retracted positions illustrated in FIG. 22(*a*) to grip both sides of a predetermined location of the bag equipped with gas compartment underneath the incision or opening formed at the upper edge of the gas compartment portion 2 (blockage region). During the process that the expanded gas compartment portion 2 is collapsed into a flat configuration, excess film 3, 4 expands sideways in the width direction of the gas compartment portion 2, and as a result, longitudinal creases 8 are produced on the opposite sides of the gas compartment portion 2.

In FIG. 23(*b*), the gripping elements of the gas blocking gripper 5 is closest to each other and the gas compartment portion 2 has been collapsed. In the area of the longitudinal creases 8 shown in FIG. 23(*a*), the film of the gas compartment portion 2 is folded and superimposed on the sealed portion 1; as a result, the gas blocking grippers 5 cannot completely collapse the blockage region of the gas compartment portion 2 into a flat configuration, and an extremely narrow flat space 9 is created in such a region.

In addition, in the gas charging method described in Japanese Patent No. 4,771,785, the width of the sealed side edge portion, in which the gas compartment portion is formed, is made considerably wider in comparison with the width of the gas compartment portion; and in addition, a gripping margin used for a bag-conveying gripper is provided outside (width W shown in FIG. 22(*a*)) the gas compartment portion (see FIG. 4 of Japanese Patent No. 4,771,785). In certain cases, the width of the sealed side edge portion, in which the gas compartment portion is formed, cannot be made significantly wider than the width of the gas compartment portion. Accordingly, when using such a bag equipped with gas compartment, it is difficult to provide a gripping margin for a bag-conveying gripper outside the gas compartment portion, and thus the gas charging method described in Japanese Patent No. 4,771,785 cannot be applied.

BRIEF SUMMARY OF THE INVENTION

The present invention is devised by taking the gas charging method and described in Japanese Patent No. 4,771,785 into consideration.

It is a principal object of the invention to provide a method and apparatus for charging a bag that is equipped with a gas compartment portion with a gas which ensures that fluid communication of gas between the incision or opening and the interior of the gas compartment portion can be reliably blocked when blockage region of the gas compartment portion is gripped by a gas blocking gripper.

Further, it is another object of the present invention to provide a method and apparatus for charging a bag that is equipped with a gas compartment portion with a gas in which the gas charging method described in Japanese Patent No. 4,771,785 is allowed to apply even when a bag equipped with gas compartment, in which a gripping margin used for a bag-conveying gripper cannot be provided outside the gas compartment portion is used.

The above-objects are accomplished by unique steps of the present invention for charging (filling-in) a gas into a bag equipped with gas compartment, and in the present invention, the method uses a bag equipped with gas compartment, the bag being formed integrally therewith a gas compartment portion extending in the longitudinal direction in a sealed side edge portion of the bag and formed with an incision or an opening (collectively called "gas inlet") which is for placing the exterior of the bag in communication with the interior of the gas compartment portion and is provided in the surface of the film that makes the gas compartment portion, and accomplishes the charging of the gas compartment portion with a gas by aligning the discharge outlet of a nozzle connected to a pressurized gas supply source with the gas inlet, injecting the gas from the nozzle into the gas compartment portion through the gas inlet, and, while the injection is in progress, gripping a blockage region configured in the vicinity of the gas inlet with a gas blocking gripper on both sides of the bag to block fluid communication of gas between the gas inlet and the interior of the gas compartment portion, and then, while maintaining the blocked state, clamping both sides of the bag in a location of the gas inlet or in a location in the vicinity of the gas inlet with hot plates thus sealing the gas inlet or the location in the vicinity of the gas inlet; and in this method, during the injection of gas into the gas compartment portion and the expansion of the gas compartment portion, the expansion of an restriction region configured in the vicinity of the blockage region is restricted on both sides of the bag, so that the expanded shape of the restriction region is restricted to a flat configuration.

The present invention can take various different forms such as those described below:

(1) Manner of Gas Injection (a) A bag backing member is provided so as to face the nozzle with the bag equipped with gas compartment therebetween, and the bag backing member supports the back of the bag during the injection of a gas (method described in Japanese Patent No. 4,771,785).

(b) The gas compartment portion can be formed between the film sheets that constitute the front and rear surface of the gas compartment portion in the sealed side edge portion of the bag and, in addition, an incision or an opening can be formed in the front and rear film surface; and in these structures, nozzles are positioned facing each other on both sides so that the bag equipped with gas compartment is sandwiched therebetween, both nozzles are aligned with the gas inlet in the respective front or rear surfaces, thus injecting the gas into the gas compartment portion.

(2) Manner of Restricting Expansion of Restriction Region (a) An expansion-restricting gripper holds, from both sides of the bag, the restriction region between its opposed faces before gas is injected into the gas compartment portion. When the gas is thus injected, the gap between opposed faces of the expansion-restricting gripper in the restriction region is set to be slightly wider than the thickness of the film of the gas compartment portion. For example, a shallow groove defining the gap is formed in the opposed faces (either one or both) of the expansion-restricting gripper, and the restriction region is held between the opposed faces at the shallow groove.

(b) An expansion-restricting gripper grips, from both sides of the bag, the restriction region before gas is injected into the gas compartment portion. The gripping force of the expansion-restricting gripper is set to be slightly smaller than the force of expansion of the gas compartment portion in the process of gas injection, so that when gas is injected into the gas compartment portion and the restriction region expands, the action of the expansion force causes the gap between the opposed faces of the expansion-restricting gripper to widen slightly against (overcoming) the gripping force of the expansion-restricting gripper.

(c) Bag-conveying gripper having a shallow groove formed in the opposed faces (gripping surfaces) thereof or a bag-conveying gripper whose gripping force is set to be slightly smaller than the force of expansion of the gas compartment portion in the process of gas injection can be used instead of the above-described expansion-restricting gripper. The bag-conveying grippers, which correspond to the grippers 8, 8 described in Japanese Patent No. 4,771,785, grip the sealed portions on both sides of the bag equipped with gas compartment and convey the bag along a predetermined conveying path in a continuous or intermittent manner. In a pair of left and right bag-conveying grippers, the bag-conveying gripper that grips the sealed side edge portion where the gas compartment portion is formed may have the above-described groove formed in its opposed faces (gripping surfaces) or have its gripping force set in the above-described manner.

The above-described objects are further accomplished by unique structures of the present invention for an apparatus for charging a bag equipped with gas compartment with a gas, and this apparatus is for carrying out the gas charging method above-described.

According to the gas charging method and apparatus of the present invention, it is possible to prevent the generation of the longitudinal creases seen in the gas charging method of Japanese Patent No. 4,771,785 and reliably block fluid communication of the gas between the gas inlet and the interior of the gas compartment portion when the blockage region of the gas compartment portion is gripped by the gas blocking gripper.

In addition, when using a bag-conveying gripper whose gripping force is set to be smaller than the force of expansion of the gas compartment portion in the process of gas injection, or when using a bag-conveying gripper, in which shallow grooves are formed in its opposed faces (gripping surfaces) thereof, and the restriction region is held at the groove portion(s), there is no need to provide a gripping margin for a bag-conveying gripper outside the gas compartment portion. As a result, the gas compartment portion can be gripped by the bag-conveying gripper and gas can be easily charged into the gas compartment portion.

DETAILED DESCRIPTION OF THE INVENTION

A gas charging method and apparatus according to the present invention will be described below in detail with reference to FIG. 1 through FIG. 21(*b*).

Embodiment 1

Figure 1:
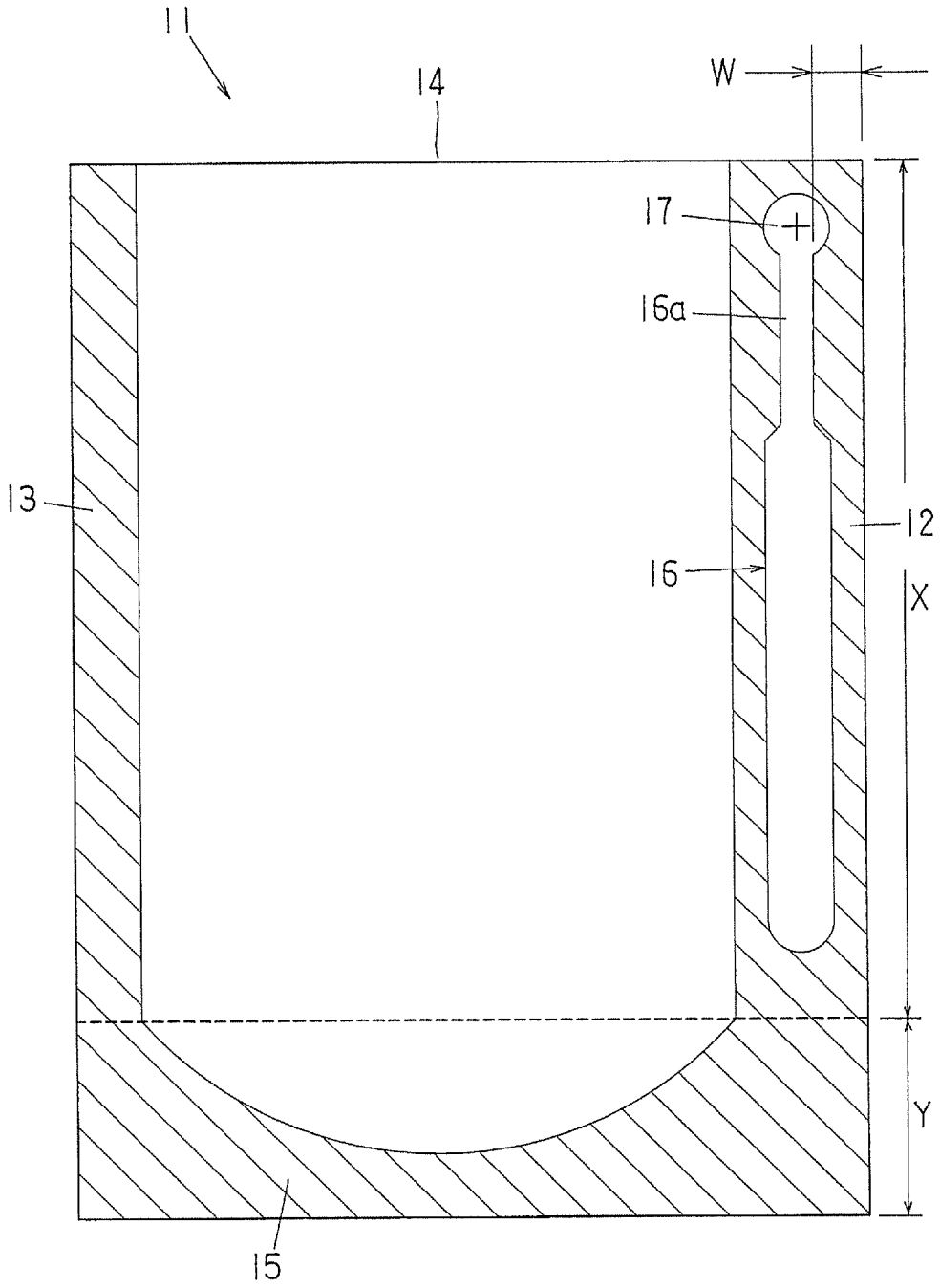
FIG. 1 is a front view of a bag equipped with gas compartment used in the present invention.

FIG. 1 shows a bag 11 equipped with a gas compartment. The bag 11 is a bottom-gusseted self-supporting bag that is made up of front and rear film sheets, as well as folded film in the bottom portion. In the upper region X of the bag 11, the front and rear film sheets of the bag 11 are bonded together along the two lateral edges, thereby forming sealed portions 12, 13. The front and rear film sheets along the upper edge are not bonded together, thus forming an open mouth 14 of the bag 11. In the lower region Y of the bag 11, the front and rear film sheets are bonded along the two lateral edges, thereby sandwiching the film of the bottom portion, and, in addition, are bonded on the inside, where the film of the bottom portion itself is also folded inward, while in the central portion, the front and rear film sheets are respectively bonded to the sheet of film of the bottom portion (the films of the folded bottom portion are not bonded), thereby forming a sealed portion 15. The sealed portions 12, 13 and 15 are indicated with oblique hatching in FIG. 1.

An unbonded portion 16 (which is a gas compartment portion 16), in which the front and rear film sheets are not bonded together, is formed in part of the sealed portion 12.

Figure 7B:
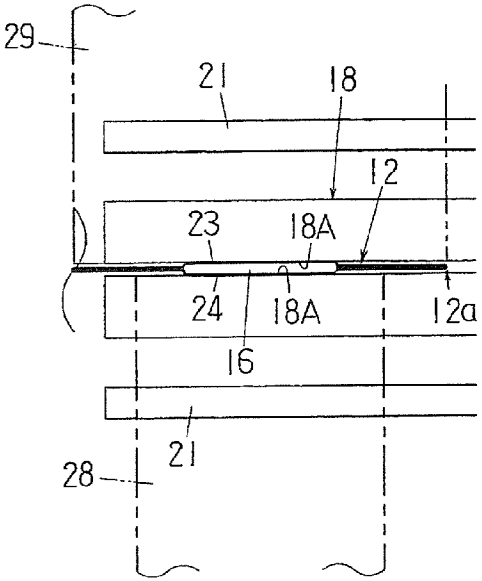
FIGS. 7(*a*) and 7(*b*) are enlarged horizontal cross-sectional views of the main elements working in the gas charging method, wherein FIG. 7(*a*) shows a state before the injection of the gas, and FIG. 7(*b*) shows a state during the injection of the gas.
Figure 7A:
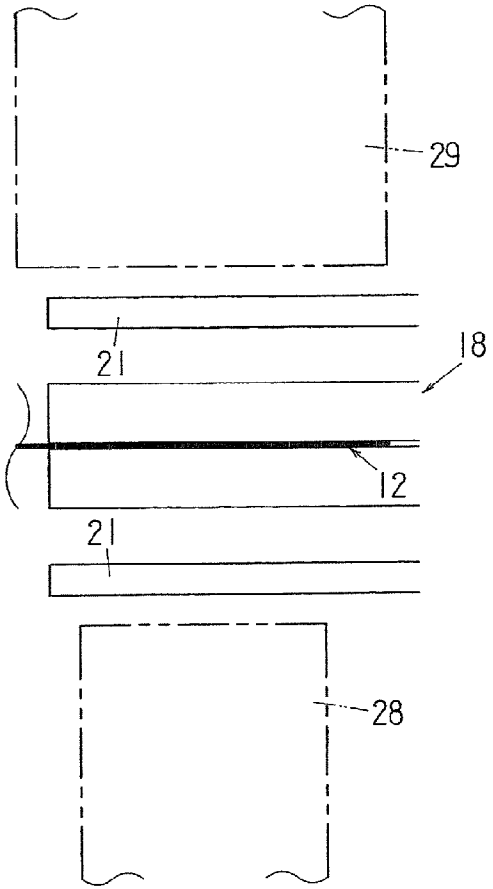

The gas compartment portion 16 of the bag 11 is a portion where no pressure is applied and sealing does not take place when the front and rear film sheets 23 and 24 (see FIG. 7(*b*)) are heat sealed. The gas compartment portion 16 has a closed, elongated and narrow outline that extends downwardly from the vicinity of the mouth 14 (upper edge of the sealed portion 12) and has a cross-shaped incision (or a gas inlet) 17 in the upper end area. The cross-shaped incision 17 places the interior of the gas compartment portion 16 in communication with the exterior of the bag, and it is formed in the film on both the front and back side or one of front and back sides in the vicinity of the upper edge. A neck section 16*a* is formed in the upper area of the gas compartment portion 16. The neck section 16*a* extends over a predetermined length from the incision 17 in a width narrower (smaller) than the other (or main) part of the gas compartment portion 16. A bag-conveying gripper 18 and a gas blocking gripper 21, to be described below, grip, in a horizontally spanning configuration, the location where this neck section 16*a* is formed within the sealed portion 12.

Methods, utilizing the bag 11 equipped with gas compartment, to manufacture a product packaged bag equipped with gas compartment by a rotary-type packaging apparatus (including gas charging methods and apparatus) will be described below with reference to FIGS. 2 through 8(*b*).

Figure 2:
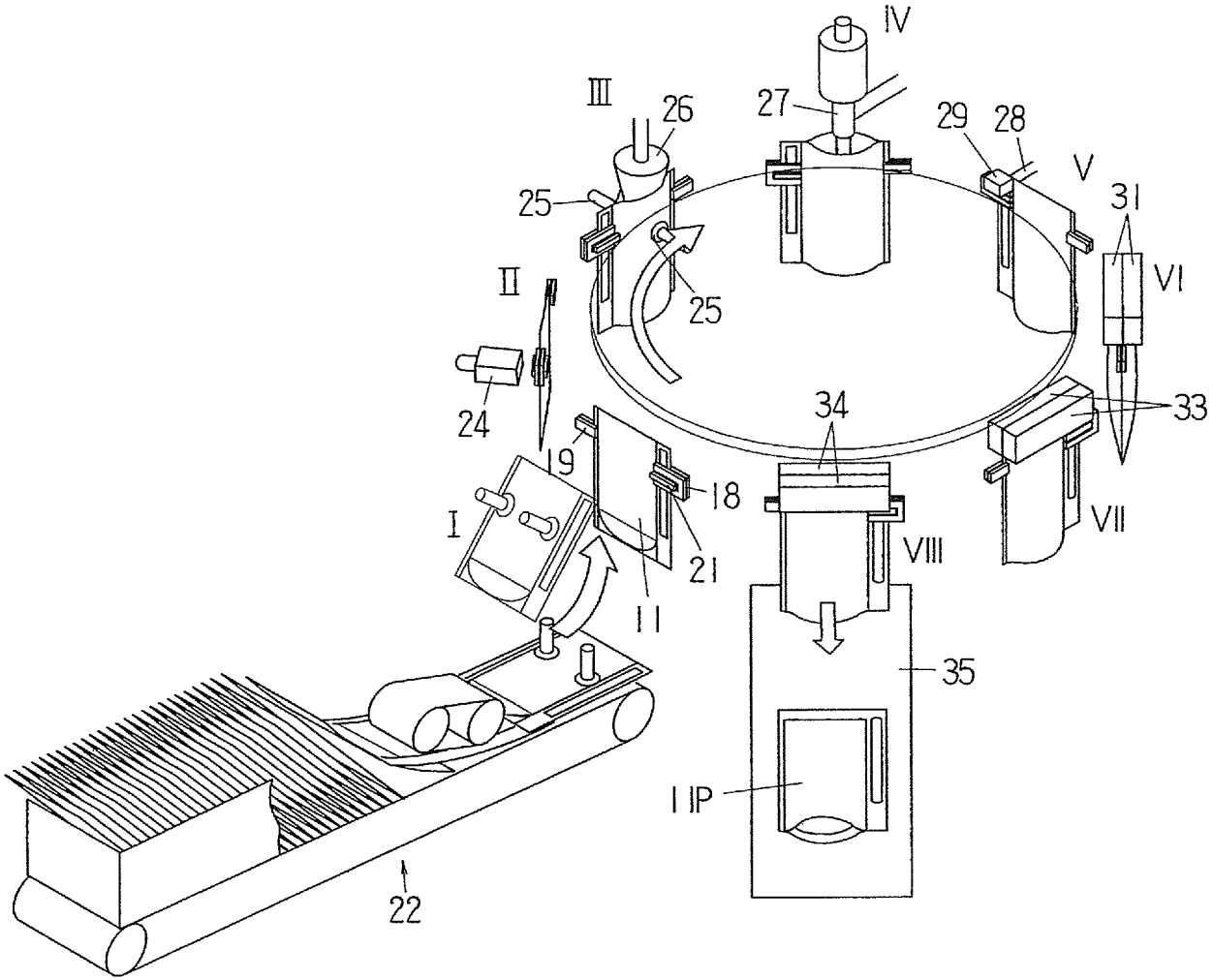
FIG. 2 is a schematic perspective view of a rotary-type packaging apparatus used to carry out by a gas charging method of the present invention.
Figure 5B:
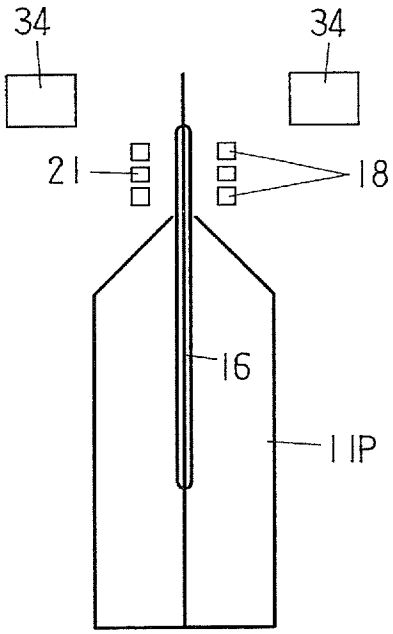
FIGS. 5(*a*) and 5(*b*) are side views that illustrate a step-by-step explanation of the further subsequent steps.
Figure 5A:
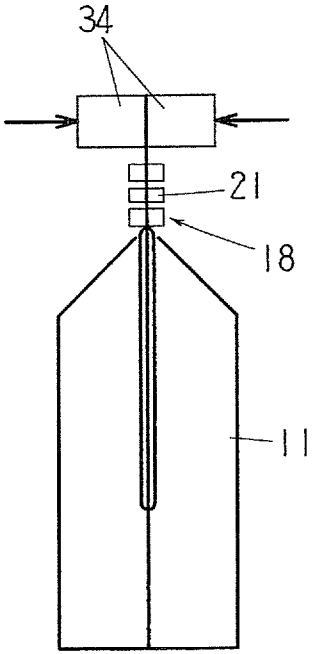

In the same manner as the rotary-type packaging apparatus of FIG. 5 of Japanese Patent No. 4,771,785, the rotary-type packaging apparatus illustrated in FIG. 2 has multiple pairs of bag-conveying grippers 18 and 19 installed at regular intervals around an intermittently rotating table, and grippers grip the two lateral edges of the supplied bag 11 equipped with gas compartment and hold the bag in a suspended state while intermittently conveying it along a circular conveying path. After supplying the bag 11 equipped with gas compartment to the grippers 18 and 19, in each stop position (in stop positions I-VIII) where the grippers 18 and 19 stop, the bag 11 gripped by the grippers 18 and 19 is subject to consecutive packaging operations including opening the mouth of the bag, filling it with the material to be packaged (contents), sealing the mouth of the bag, etc. In addition, the operation of charging (or filling-in) the gas compartment portion 16 with a gas is also performed (which comprises a step of filling the gas compartment portion 16 with a gas and a step of closing (sealing) the incision 17).

Figure 6C:
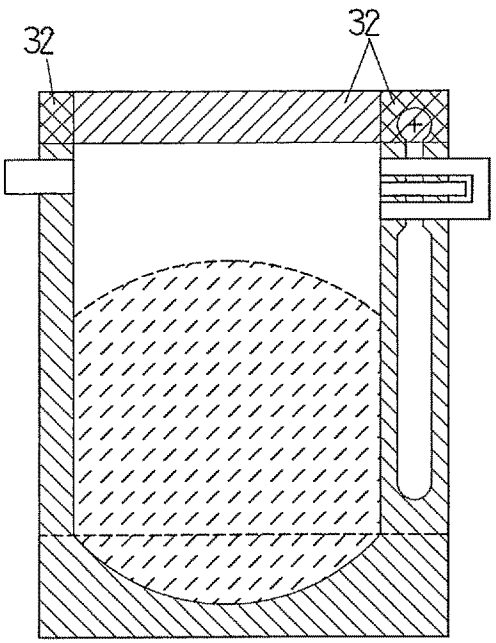
FIGS. 6(*a*) through 6(*c*) are front views illustrating the gas charging method of the present invention used in the rotary-type packaging apparatus of FIG. 2, wherein FIG. 6(*a*) shows the bag equipped with gas compartment at the empty bag supplying station, FIG. 6(*b*) shows the bag at the gas filling station, and FIG. 6(*e*) shows the bag at the sealing station.
Figure 6B:
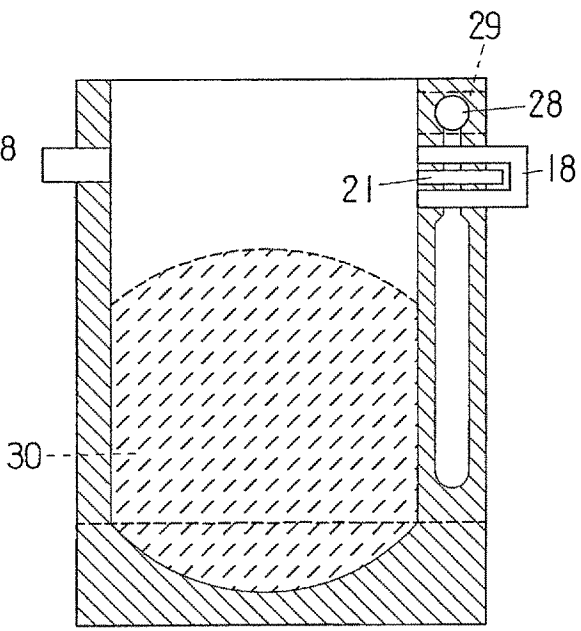
Figure 6A:
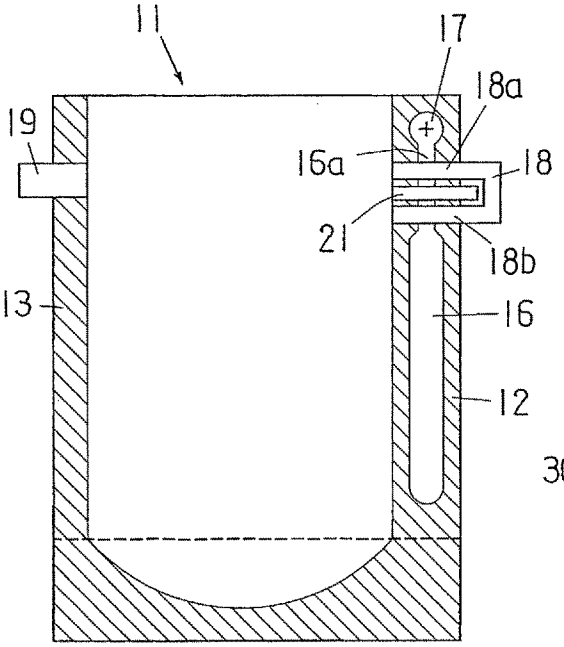

As shown in FIGS. 6(*a*) through 6(*c*), the gripper 18, i.e. one of the two grippers 18 and 19, is shaped substantially like the letter "U" turned on its side when viewed from the front, and its top and bottom transverse portions 18*a* and 18*b* grip the front and back sides of the sealed side edge portion 12 in which the gas compartment portion 16 is formed. The location where the gripping is made is a location in the vicinity of the incision 17 in which the neck section 16*a* is formed in the gas compartment portion 16, and the gripper 18 grips the neck section 16*a* in a horizontally spanning configuration. The other gripper 19, which is a regular gripper similar to the gripper 8 described in Japanese Patent No. 4,771,785, grips the sealed side edge portion 13 of the bag, where no gas compartment portion is formed, at substantially the same height as the gripper 18.

While the width W (see FIG. 1) of the external portion outside the gas compartment portion 16 within the sealed portion 12 of the bag 11 equipped with gas compartment is narrow and insufficient for this portion to be used as a gripping margin for a regular gripper, such as the gripper 19, it presents no problem at all when the bag is gripped by the gripper 18 as will be described below.

Since the above-described rotary-type packaging apparatus carries out the gas charging step, in the same manner as in the rotary-type packaging apparatus described in Japanese Patent No. 4,771,785, a gas filling means is provided in a predetermined stop position, and one gas blocking gripper 21 that grips the front and rear surface of a predetermined region in the vicinity of the incision 17 (in the present invention, this region of the gas compartment portion 16 is referred to as a "blockage region") is provided for every pair of grippers 18 and 19. As shown in FIGS. 6(*a*) through 6(*c*), the blockage region is located between the transverse portions 18*a* and 18*b* of the gripper 18 and, at the same time, extremely close to the transverse portions 18*a* and 18*b*. The gas blocking gripper 21 grips the blockage region configured in the neck section 16*a* of the gas compartment portion 16 in a horizontally spanning configuration, thus blocking fluid communication of the gas between the incision 17 and the interior of the gas compartment portion 16. The gas blocking gripper 21 travels in an intermittent manner together with the grippers 18 and 19.

The gas filling means is provided with a gas injection nozzle 28 and a bag backing member 29, to be described hereafter.

Figure 3C:
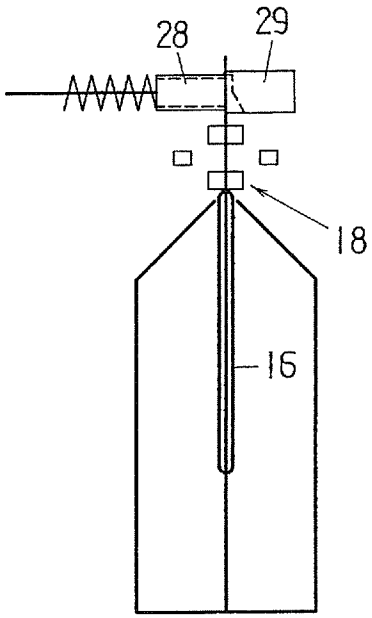
FIGS. 3(*a*) through 3(*c*) are side views that illustrate a step-by-step explanation of the gas charging method and packaging method carried out using the rotary-type packaging apparatus of FIG. 2.
Figure 3B:
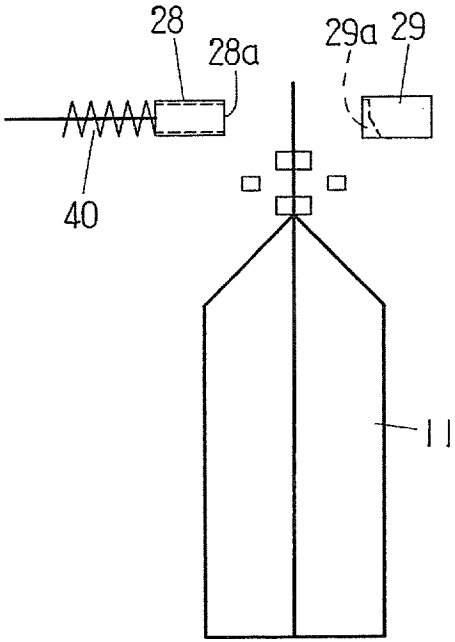
Figure 3A:
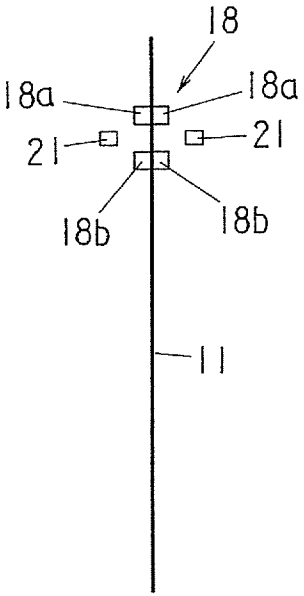

The packaging process that uses the rotary-type packaging apparatus illustrated in FIG. 2 is implemented in the following manner:

(1) In stop position I (bag-supplying station), a bag 11 equipped with gas compartment is supplied to the grippers 18 and 19 from a conveyer magazine-type bag-supplying device 22, and the grippers 18 and 19 grip the front and back side of predetermined locations in the sealed portions 12, 13 of the bag. A predetermined region in the vicinity of the blockage region within the neck section 16*a* of the gas compartment portion 16 (in the present invention, such region of the gas compartment portion 16 is referred to as a "restriction region(s)") is gripped by the gripper 18 (more specifically by the transverse portions 18*a* and 18*b*). This state is illustrated in FIG. 3(*a*) and FIG. 6(*a*). At such time, the gas blocking gripper 21 is open.

The gripping force of the gripper 18 is set to a magnitude described hereafter (or it is set to be smaller than usual), and the gripping force of the gripper 19 is set to a regular magnitude. As shown in FIG. 7(*a*), in the restriction regions of the neck section 16*a* of the gas compartment portion 16, both sides of which are gripped by the gripper 18 (transverse portions 18*a* and 18*b*), the film sheets 23 and 24 that constitute the front and rear surfaces are in intimate contact with each other and are completely collapsed.

(2) In stop position II (printing station), printing (of lettering) is made on the surface of the bag by a printer (only its print head portion 24 is shown).

(3) In stop position III (mouth-opening station), the mouth of the bag is opened by a mouth-opening device (only its suction cup 25 and opening head 26 are shown).

(4) In stop position IV (filling station), the bag is filled with a, for instance, liquid substance by a filling device (only its nozzle portion 27 is shown) (see filled material 30 in FIG. 6(*b*)).

(5) In stop position V (gas filling station), a bag backing member 29 and a gas injection nozzle 28, which are parts of the gas filling means, are provided in the vicinity of the conveying path of the bag 11 equipped with gas compartment. The nozzle 28, which is connected to a pressurized gas supply source via a diverter valve (not shown) and the like, advances towards or retracts from the bag 11, and the discharge opening 28*a* at a distal end thereof is aligned with the incision 17 of the bag at an advanced position thereof. The bag backing member 29, which is provided opposite the nozzle 28, thereby sandwiching the bag 11 therebetween, advances towards or retreats from the bag 11 and supports the back side of the bag 11 while facing the discharge opening 28*a* of the nozzle 28 in an advanced position thereof. A recessed portion 29*a* is provided in a distal end of the bag backing member 29. The nozzle 28 is biased forward by a compression spring 40.

As shown in FIG. 3(*b*), when the bag 1 stops at the gas filling station, the nozzle 28 and bag backing member 29 retreat (or move away from each other) and remain in that standby position. Subsequently, as shown in FIG. 3(*c*) and FIG. 6(*b*), the nozzle 28 and bag backing member 29 advance in synchronism so that the discharge opening 28*a* at the distal end of the nozzle 28 abuts the surface of the bag around the incision 17 while the back of the bag is supported by the bag backing member 29. Compressed gas is then discharged from the distal end of the nozzle 28 and injected into the gas compartment portion 16 through the incision 17. As a result, the internal pressure in the gas compartment portion 16 increases, and the gas compartment portion 16 inflates or expands.

During the injection of the gas, the nozzle 28 retreats (to be shifted away from the bag) slightly against the bias of the compression spring 40 under the action of the (air) pressure by the injected gas. As a result, a space is created between the film sheets 23 and 24 that form the gas compartment portion 16, and the gas is injected into the gas compartment portion 16 through the incision 17 (see Japanese Patent No. 4,771,785). In addition, since a recessed portion 29*a* is provided at the distal end of the bag backing member 29, the expansion of the gas compartment portion 16 takes place on the back side of the incision 17, thereby enhancing the inflow of the gas through the incision 17.

When the internal pressure in the gas compartment portion 16 increases as a result of the gas injection, and the gas compartment portion 16 starts to expand in the regions gripped by the bag-conveying gripper 18 (which are the restriction regions), the force of its expansion acts upon the bag-conveying gripper 18, and the gripping force of the bag-conveying gripper 18 yields. As a result, as shown in FIG. 7(*b*), the gap between the (two) opposed faces (gripping surfaces) 18A, 18A of the bag-conveying gripper 18 is widened to a position where the expansion force and the gripping force balance each other out. A space is thus created between the two film sheets 23 and 24 in the regions gripped by the bag-conveying gripper 18 (the restriction regions), and the compressed gas flows through the space into the gas compartment portion 16 below the restriction regions, which freely expands in response to the pressure of the gas. On the other hand, while the gas compartment portion 16 expands in response to the pressure of the gas in the regions gripped by the bag-conveying gripper 18 (the restriction regions) as well as in the vicinity thereof, the expansion is restricted by the bag-conveying gripper 18, and for this reason the expanded shape of the gas compartment portion 16 is restricted to a flat configuration.

Figure 22B:
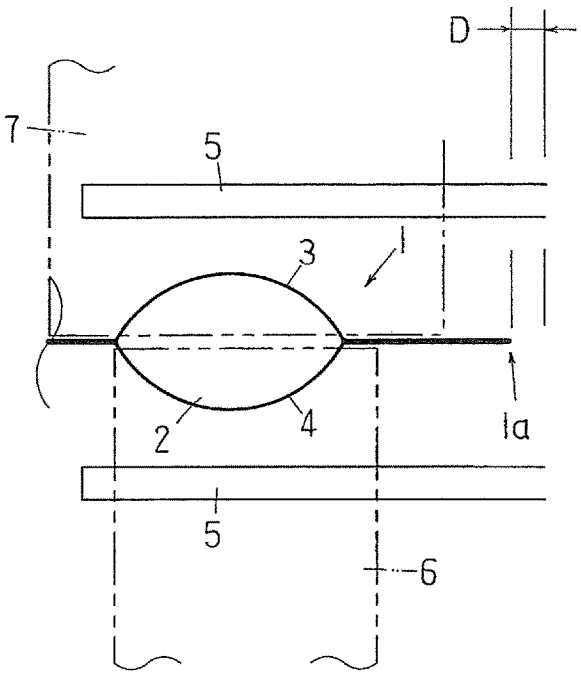
FIG. 22(b) RELATED ART
FIGS. 22(*a*) and 22(*b*) are enlarged horizontal cross-sectional views of the main elements working in the gas charging method described in Japanese Patent No. 4,771,785, wherein FIG. 22(*a*) shows a state before the injection of the gas, and FIG. 22(*b*) shows a state during the injection of the gas.
Figure 22A:
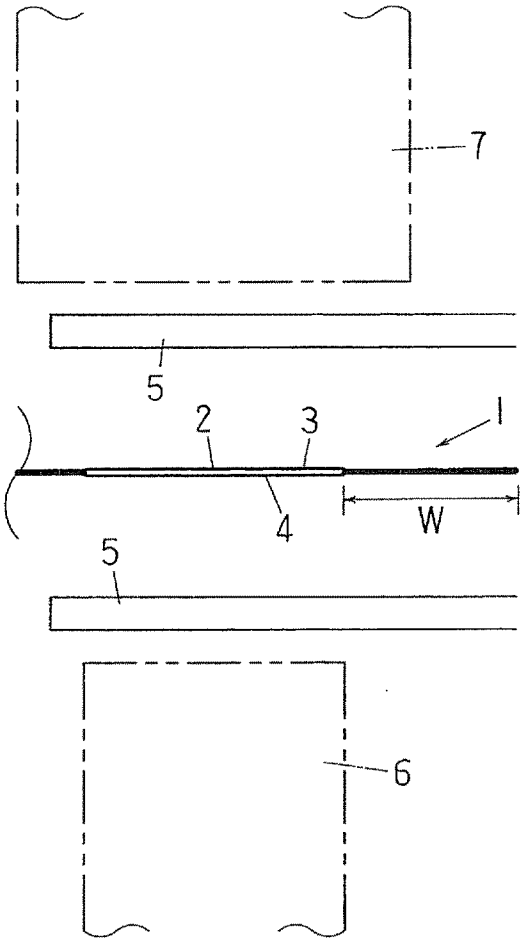
FIG. 22(a) RELATED ART

The magnitude of the gripping force of the bag-conveying gripper 18 is preferably set so that during the injection of the gas, the gap between the two opposed faces (gripping surfaces) 18A, 18A of the bag-conveying gripper 18 is slightly widened and the expanded shape of the restriction regions of the gas compartment portion 16 is reduced to an extremely thin flat configuration. With this setting, it becomes possible to ignore the distance (see distance D in FIG. 22(*b*)) that the edge 12*a* of the sealed portion 12 travels following the expansion of the gas compartment portion 16.

Figure 4C:
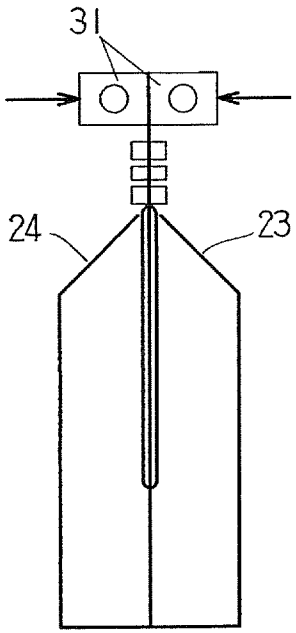
FIGS. 4(*a*) through 4(*c*) are side views that illustrate a step-by-step explanation of the subsequent steps.
Figure 4B:
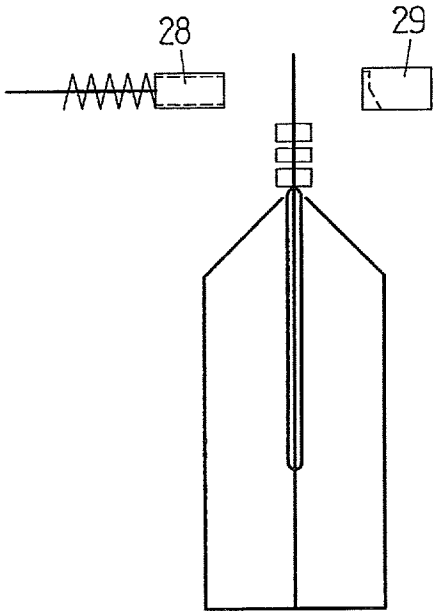
Figure 4A:
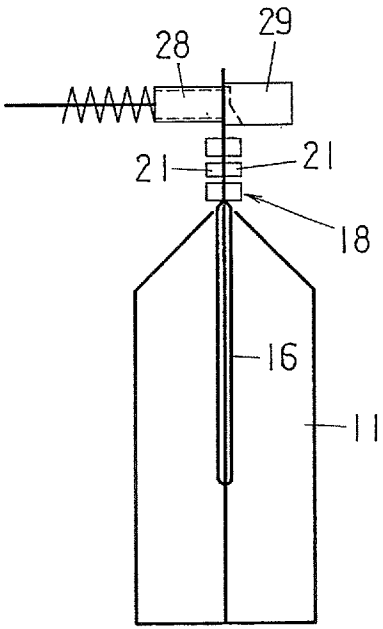

Subsequently, as shown in FIG. 4(*a*), the gas blocking gripper 21 closes and grips both sides of the blockage region configured between the transverse portions 18*a* and 18*b* of the bag-conveying gripper 18 (between the restriction regions), thus blocking the fluid communication of the gas between the incision 17 and the interior of the gas compartment portion 16, and preventing gas from escaping from the gas compartment portion 16 through the incision 17.

Figure 8B:
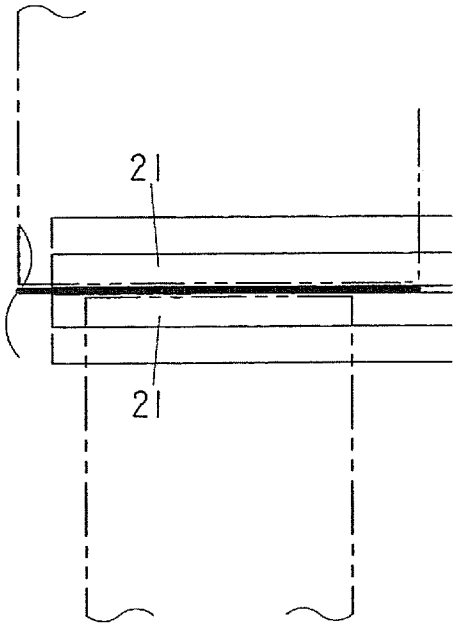
FIGS. 8(*a*) and 8(*b*) are enlarged horizontal cross-sectional views of the main elements, wherein FIG. 8(*a*) shows a state in which the bag is being gripped by a gas blocking gripper, and FIG. 8(*b*) shows a state after the bag has been gripped.
Figure 8A:
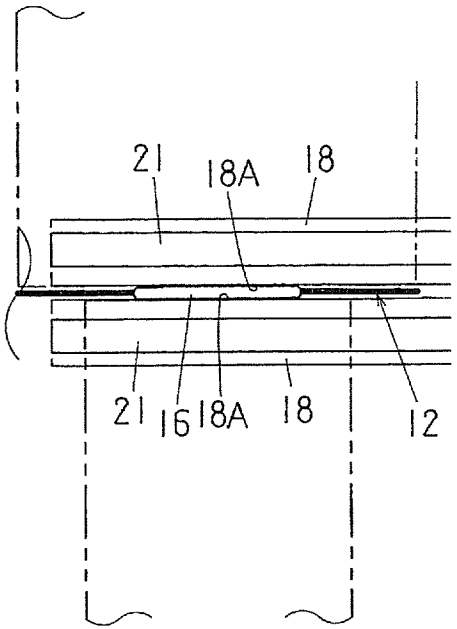
Figure 23B:
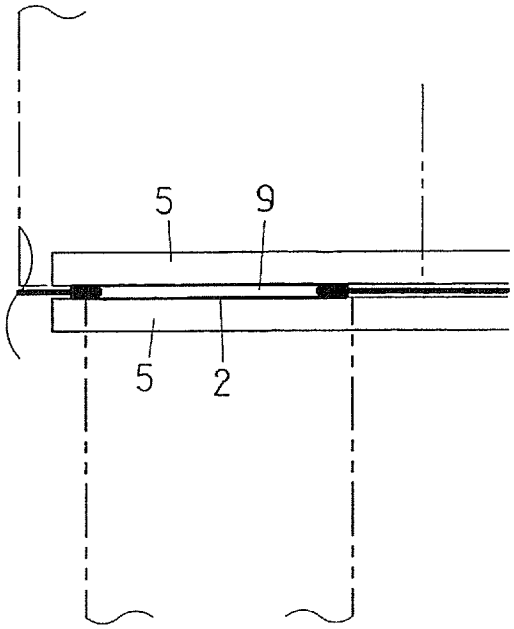
FIG. 23(b) RELATED ART
FIGS. 23(*a*) and 23(*b*) are enlarged horizontal cross-sectional views of the main elements, wherein FIG. 23(*a*) shows a state wherein the bag is being gripped by the gas blocking gripper, and FIG. 23(*b*) shows a state after the bag has been gripped.
Figure 23A:
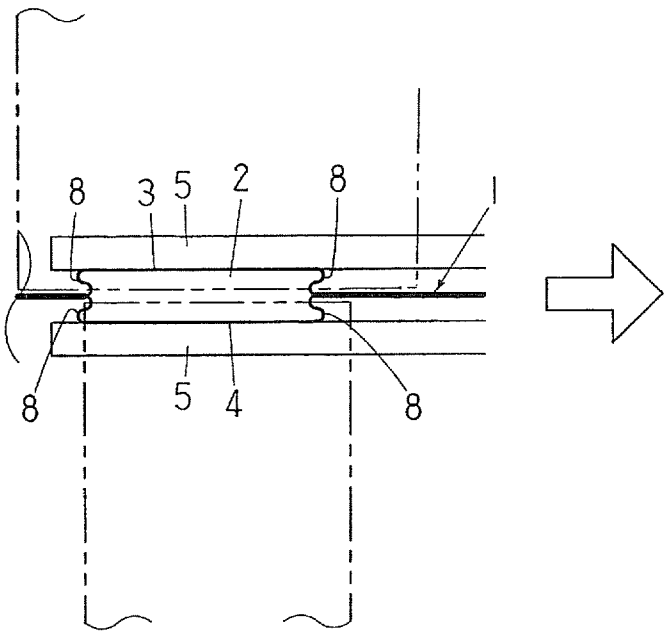
FIG. 23(a) RELATED ART

In the gas charging method described in Japanese Patent No. 4,771,785, as seen from FIG. 23(*a*), when the gas blocking gripper 5 is closed and grip the freely expanded gas compartment portion 2, longitudinal creases 8 appear on both sides of the gas compartment portion 2. As a result, even when the (gripping elements of the) gas blocking gripper 5 is fully closed, the gas compartment portion 2 cannot be completely collapsed into a flat configuration, so that a thin flat space 9 is created in the gas compartment portion 2 and gas escapes from the gas compartment portion 2 through this space 9. On the other hand, in the present invention, when the gas blocking gripper 21 closes and grips the gas compartment portion 16, as shown in FIG. 8(*a*), the generation of the above-described longitudinal creases can be prevented because the expanded shape of the gas compartment portion 16 is restricted to a flat configuration by the bag-conveying gripper 18 in the vicinity of the top and bottom of the blockage regions (the restriction regions) gripped by the gas blocking gripper 21. Furthermore, as shown in FIG. 8(*b*), when the gas blocking gripper 21 is fully closed, the blockage region of the gas compartment portion 16 is fully collapsed into a flat configuration, and the fluid communication of the gas between the incision 17 and the interior of the gas compartment portion 16 is blocked.

The blockage region gripped by the gas blocking gripper 21 and the restriction regions gripped by the bag-conveying gripper 18 are configured in the neck section 16*a* formed in the gas compartment portion 16; and as a result, the degree of expansion of the gas compartment portion 16 in that regions is by its nature not very high. This configuration provides a considerable effect in terms of preventing the generation of the longitudinal creases described above.

Once the blockage region of the gas compartment portion 16 is gripped by the gas blocking gripper 21, the discharge of the gas from the nozzle 28 (the injection of gas into the gas compartment portion 16) is stopped, and then, as shown in FIG. 4(*b*), the nozzle 28 and the bag backing member 29 are moved away from the surface of the bag and retreat to their retracted positions or the standby positions. The gas filling step thus completes.

(6) In stop position VI (first sealing station), a first sealing device (only a pair of its hot plates 31 is shown) is provided, which seals the mouth of bags, so that when the bag 11 equipped with gas compartment stops at this first sealing station, the hot plates 31 are in a standby position located at a certain distance from the bag 11. The width, or the length in its height direction, of the hot plates 31 is set to be sufficient to cover the incision 17. As shown in FIG. 4(*c*), when the plates 31 are closed to clamp the bag 11 equipped with gas compartment from both sides, the film sheets 23 and 24 that constitute the front and rear surface of the gas compartment portion are sealed at the mouth of the bag, thereby hermetically enclosing the contents for the bag inside the bag 11. At the same time, the sealing of the film sheets 23 and 24 also closes the location of the incision 17, thereby entrapping the gas in the interior of the gas compartment portion 16. The sealed portions 32 at the mouth of the bag sealed by the hot plates 31 are illustrated in FIG. 6(*c*). In this manner, the first sealing step is carried out for sealing both of the bag mouth and the incision 17 in combination.

The hot plates 31 are next opened, and thus the first sealing step is completed.

(7) In stop position VII (second sealing station), a second sealing device (only its pair of hot plates 33 is shown) is provided that seals the mouth of the bag. A second sealing step is carried out in this second sealing station, during which, in the same manner as in the first sealing step, the sealed portions 32 are again clamped by hot plates 33, and the sealing of the bag mouth and the incision 17 are both performed simultaneously.

(8) In stop position VIII (seal cooling and discharge station), a seal cooling device (only its pair of cooling plates 34 is shown) is provided that cools the sealed portions 32 at the mouth of the bag. As shown in FIG. 5(*a*), the surface of the bag is clamped by the cooling plates 34 and cooled, and then, as the cooling continues, the gas blocking gripper 21 and the bag-conveying grippers 18 and 19 are opened, and further, as shown in FIG. 5(*b*), the cooling plates 34 are opened as well. As a result, the bag 11 equipped with gas compartment (or a product packaged bag 11P equipped with gas compartment) is discharged from the apparatus through the chute 35. The gas blocking gripper 21 can be set so that it opens at the stage when the first sealing step or second sealing step ends.

Embodiment 2

Figure 9:
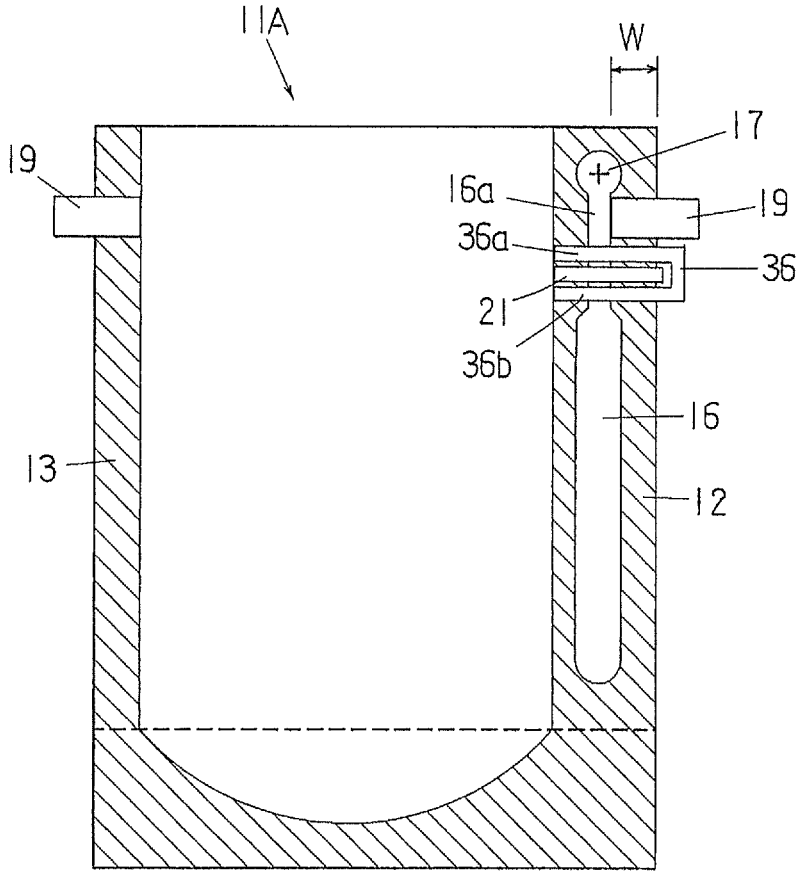
FIG. 9 is a front view for explaining another gas charging method of the present invention.
Figure 10B:
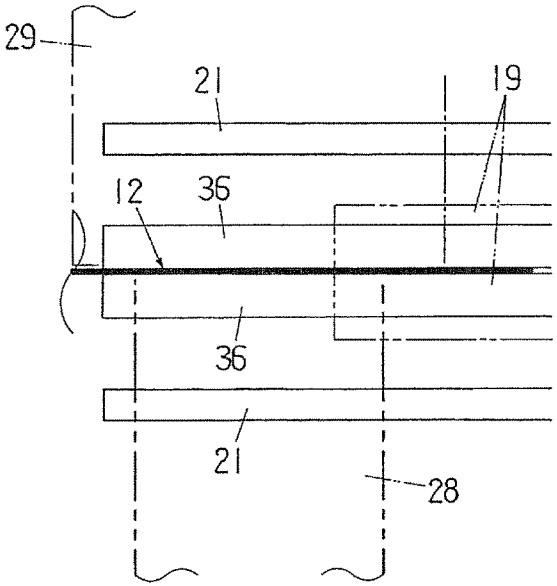
FIGS. 10(*a*) and 10(*b*) are enlarged horizontal cross-sectional views of the main elements working in the gas charging method, wherein FIG. 10(*a*) shows a state before the bag is gripped by the expansion-restricting gripper, and FIG. 10(*b*) shows a state after the bag has been gripped by the expansion-restricting gripper.
Figure 10A:
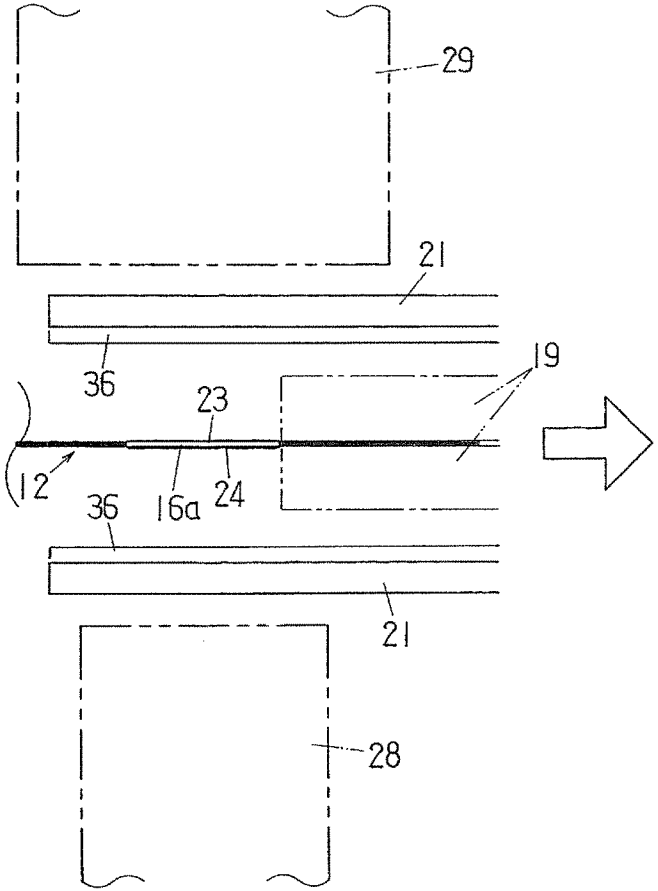
Figure 11B:
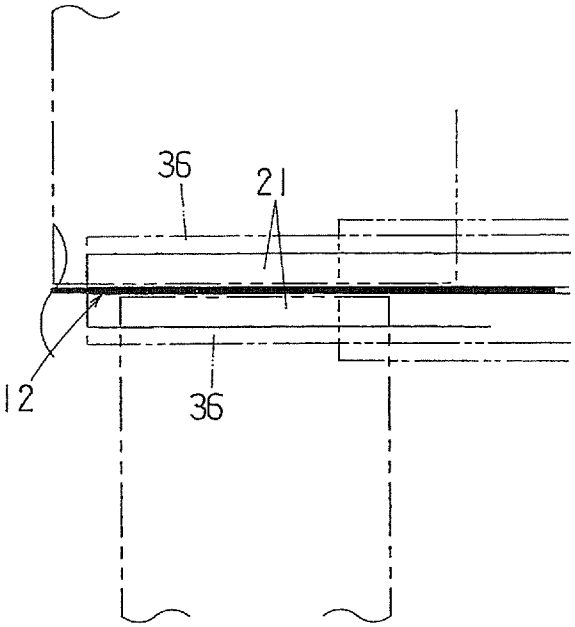
FIGS. 11(*a*) and 11(*b*) are enlarged horizontal cross-sectional views of the main elements, wherein FIG. 11(*a*) shows a state after the start of the gas injection, and FIG. 11(*b*) shows a state after the bag has been gripped by a gas blocking gripper.
Figure 11A:
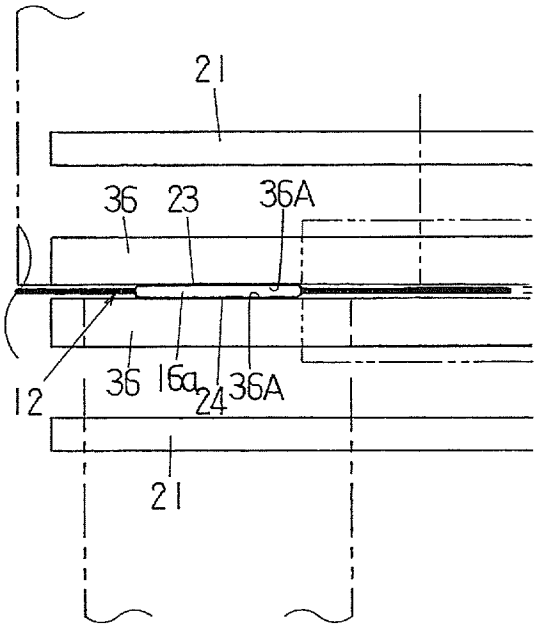

Next, another gas charging method and apparatus of the present invention will be described with reference to FIGS. 9 through 11(*b*). In FIGS. 9 through 11(*b*), the same reference numerals are assigned to substantially the same regions and elements of the bag equipped with gas compartment and gas charging apparatus described in Embodiment 1.

The bag 11A equipped with gas compartment shown in FIG. 9 differs from the bag 11 shown in FIG. 1 in that the width W of the external portion outside the gas compartment portion 16 formed within the sealed portion 12 is made slightly wider, and the same portion as in the sealed portion 13 is gripped by the bag-conveying gripper 19.

Multiple pairs of bag-conveying grippers 19, 19 are installed in the rotary-type packaging apparatus shown in FIG. 2 instead of the bag-conveying grippers 18 and 19. Also, the bag-conveying gripper 18 is not used, and an expansion-restricting gripper 36 is additionally provided as part of the gas charging apparatus.

In the same manner as the gas blocking gripper 21, one expansion-restricting gripper 36 can be provided for every pair of grippers 19, 19 (in such a case, it travels together with the grippers 19, 19 in an intermittent manner). Alternatively, one gripper (a pair of front and rear grippers) can be provided in stop position V (see FIG. 2) to handle bags 11A equipped with gas compartments that stop in this position.

Like the bag-conveying gripper 18 used in Embodiment 1, the expansion-restricting gripper 36 is shaped substantially like the letter "U" turned on its side when viewed from the front, and its top and bottom transverse portions 36*a* and 36*b* grip the front and rear sides of the sealed portion 12 with a predetermined gripping force in a horizontal configuration spanning across the neck section 16*a* of the gas compartment portion 16. The magnitude of this gripping force is set based on the same approach as the one used for the bag-conveying gripper 18 of Embodiment 1. In the same manner as the gripper of Embodiment 1, the gas blocking gripper 21 grips the front and rear sides of the sealed portion 12 in a horizontal configuration spanning across the neck section 16*a* of the gas compartment portion 16, and the location gripped thereby is positioned between the top and bottom transverse portions 36*a* and 36*b* of the expansion-restricting gripper 36. The region gripped by the gas blocking gripper 21 in the gas compartment portion 16, which is referred to as a "blockage region" in the present invention, is located in the vicinity of the incision 17. The regions of the gas compartment portion 16 gripped by the expansion-restricting gripper 36 (transverse portions 36*a* and 36*b*) are located in the vicinity of the blockage region. In the present invention, these regions are referred to as a "restriction region(s)."

The charging (filling-in) method of Embodiment 2 will be described with reference to FIGS. 9 through 11(*b*) in a manner similar to the description provided for Embodiment 1. In this Embodiment 2, it is assumed that, in the same manner as the gas blocking gripper 21, one expansion-restricting gripper 36 (comprising a pair of front and rear gripping elements) is provided for every pair of grippers 19, 19.

(1) In stop position I (bag-supplying station), the bag 11A equipped with gas compartment is supplied to the grippers 19, 19 from a conveyer magazine-type bag-supplying device 22, and, as shown in FIG. 9, the grippers 19, 19 grip a predetermined location of the sealed portion 12 (external portion of the gas compartment portion 16) and a predetermined location of the sealed portion 13. The gas blocking gripper 21 and the expansion-restricting gripper 36 are both open. This state is illustrated in FIG. 10(*a*).

(2) A printing step, a mouth-opening step, and a filling step are carried out in stop positions II-IV, respectively. On the other hand, during this period, the expansion-restricting gripper 36 is closed at a predetermined moment in time and grips the front and rear sides of the sealed portion 12 (this moment in time can be immediately before the start of the gas injection in the next stop position V). As shown in FIG. 10 (*b*), at such time, the restriction regions of the neck section 16*a* of the gas compartment portion 16 is gripped by the expansion-restricting gripper 36 (more specifically by the transverse portions 36*a* and 36*b*), the film sheets 23 and 24 that constitute the front and rear surfaces of the bag are thus in intimate contact with each other, and the restriction regions of the gas compartment portion 16 is completely collapsed.

(3) In stop position V (gas filling station), the nozzle 28 and the bag backing member 29 advance forward. and the injection of the gas starts. When the internal pressure in the gas compartment portion 16 increases as a result of the gas injection, the gas compartment portion 16 starts to expand in the regions gripped by the expansion-restricting gripper 36 (the restriction regions). The force of its expansion acts on the expansion-restricting gripper 36, and the gripping force of the expansion-restricting gripper 36 yields, so that, as shown in FIG. 11(*a*), the gap between the (two) opposed faces (gripping surfaces) 36A, 36A of the expansion-restricting gripper 36 is widened to a position where the expansion force and the gripping force balance each other out. As a result, a space is created between the two film sheets 23 and 24 in the regions gripped by the expansion-restricting gripper 36 (the restriction regions), and the compressed gas flows through the space into the gas compartment portion 16 below the restriction regions, which freely expands in response to the pressure of the gas. On the other hand, while the gas compartment portion 16 expands in response to the pressure of the gas in the regions gripped by the expansion-restricting gripper 36 (the restriction regions) as well as in the vicinity thereof, the expansion is restricted by the expansion-restricting gripper 36. As a result, the expanded shape of the gas compartment portion 16 is restricted to a flat configuration. These actions are identical to those of the bag-conveying gripper 18 described in Embodiment 1.

Subsequently, as shown in FIG. 11(*b*), the gas blocking gripper 21 closes and grips both sides of the blockage region configured between the transverse portions 36*a* and 36*b* of the expansion-restricting gripper 36 (between the restriction regions), thus blocking the fluid communication of the gas between the incision 17 and the interior of the gas compartment portion 16.

(4) A first sealing step, a second sealing step, and a seal cooling step are carried out in the stop positions VI-VIII, respectively, and a product packaged bag equipped with gas compartment is discharged from the apparatus. The expansion-restricting gripper 36 is opened and releases the sealed portion 12 at an appropriate moment in time after the gas blocking gripper 21 is closed in stop position V and before the cooling plates 34 are opened in stop position VIII. In addition, the gas blocking gripper 21 is opened and releases the sealed portion 12 at an appropriate moment in time after the first sealing step and before the cooling plates 34 are opened in stop position VIII.

Embodiment 3

Figure 12:
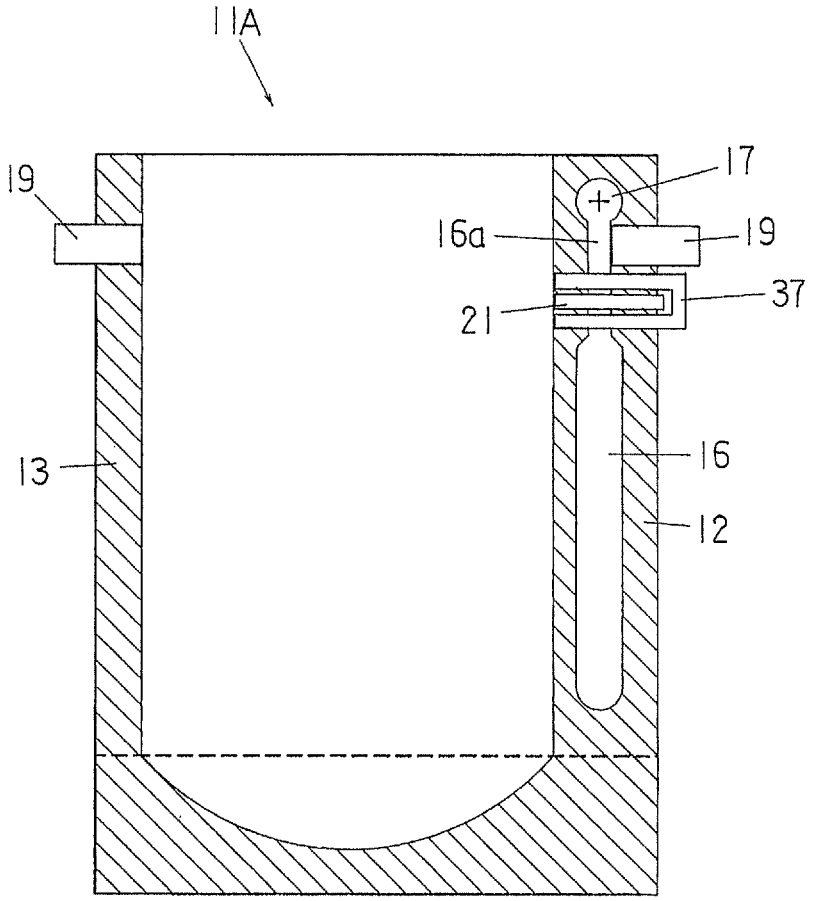
FIG. 12 is a front view of a bag equipped with gas compartment for explaining yet another gas charging method of the present invention.
Figure 13B:
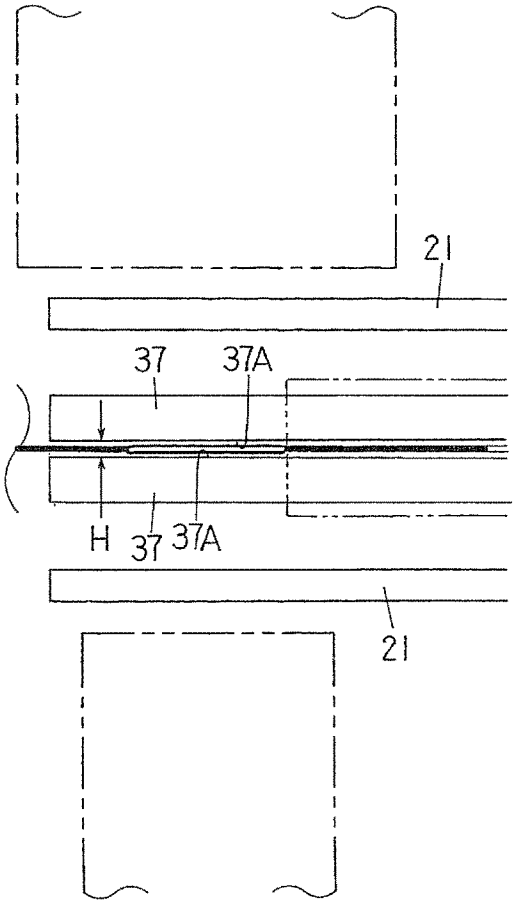
FIGS. 13(*a*) and 13(*b*) are enlarged horizontal cross-sectional views of the main elements working in the gas charging method, wherein FIG. 13(*a*) shows a state before the bag is held by the expansion-restricting gripper, and FIG. 13(*b*) shows a state after the bag has been held by the expansion-restricting gripper.
Figure 13A:
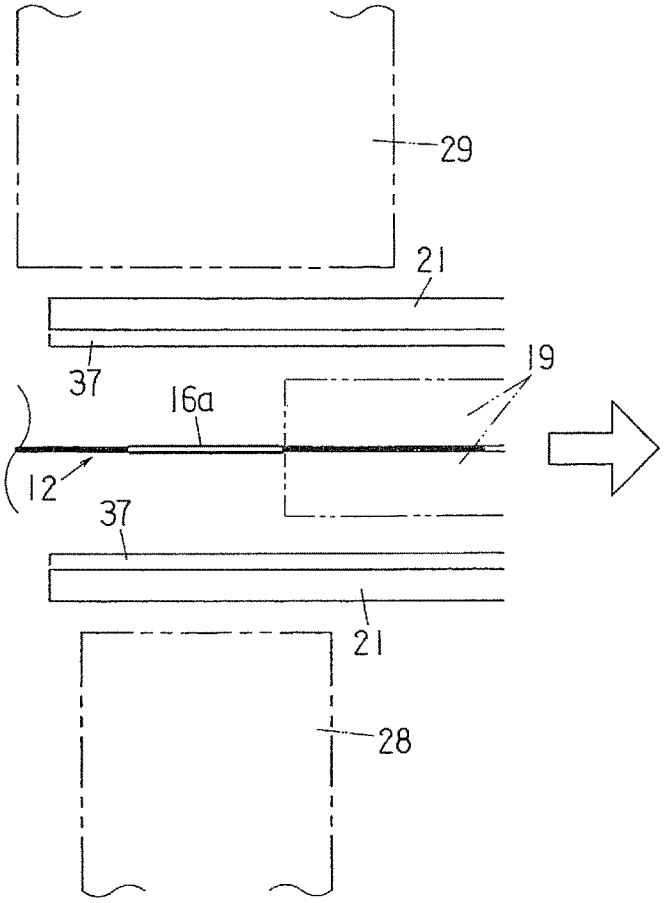
Figure 14B:
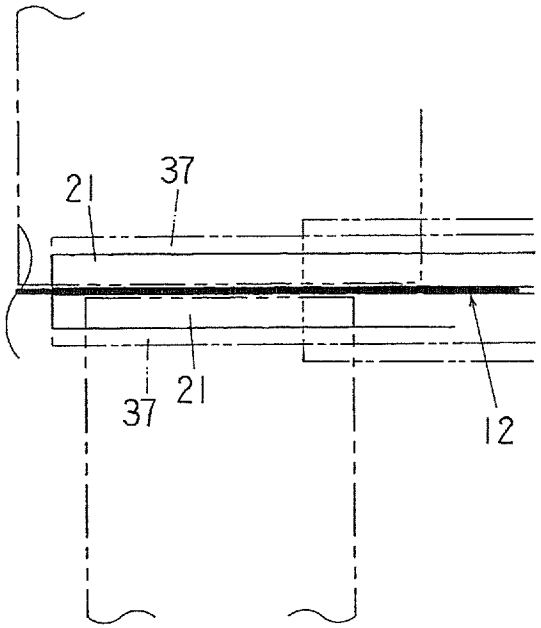
FIGS. 14(*a*) and 14(*b*) are enlarged horizontal cross-sectional views of the main elements, wherein FIG. 14(*a*) shows a state after the start of the gas injection, and FIG. 14(*b*) shows a state after the bag has been gripped by a gas blocking gripper.
Figure 14A:
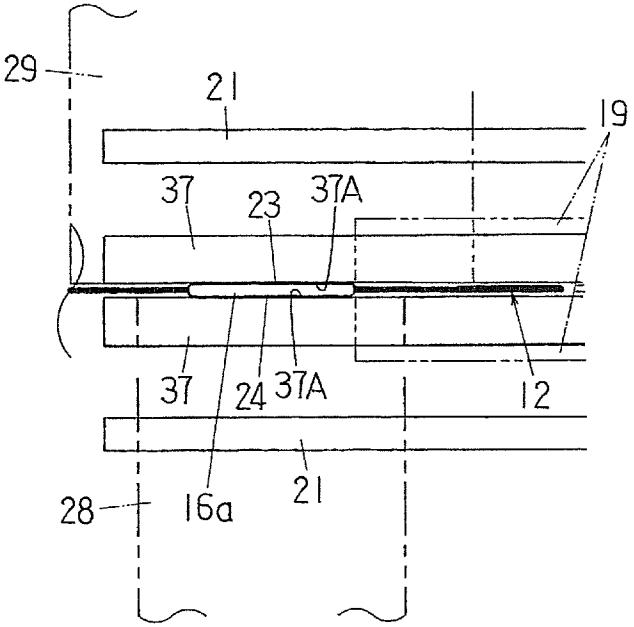

Yet another gas charging method and apparatus of the present invention will be described next with reference to FIGS. 12 through 14(*b*). In FIGS. 12 through 14(*b*), the same reference numerals are assigned to substantially the same regions and elements as those of the bag equipped with gas compartment and gas charging apparatus described in Embodiment 1.

In the gas charging (or filling-in) method and apparatus of Embodiment 3, an expansion-restricting gripper 37 is used instead of the expansion-restricting gripper 36 used in the gas charging method and apparatus described in Embodiment 2. Although the expansion-restricting gripper 37 has the same shape as the expansion-restricting gripper 36, when the gripper is closed, the gap between the two opposed faces 37A, 37A of the expansion-restricting gripper 37 is configured to be wider than the thickness of the film of the gas compartment portion 16. Therefore, when the expansion-restricting gripper 37 is closed, the sealed portion 12 of the bag 11A is, as seen from FIG. 13(*b*), only held between the two opposed faces 37A, 37A of the gripper 37 with a space of a predetermined distance H, and the sealed portion 12 is not gripped by the gripper 37. One expansion-restricting gripper 37 can be provided for every pair of grippers 19, 19 (in this case, it travels together with the grippers 19, 19 in an intermittent manner) or, alternatively, one gripper (comprising a pair of front and rear gripping elements) can be provided in stop position V (see FIG. 2) to handle bags 11A equipped with gas compartments that stop in this position.

Next, the gas charging method of Embodiment 3 will be described with reference to FIGS. 12 through 14(*b*) in a manner similar to the description provided for Embodiment 1. In this embodiment, it is assumed that, in the same manner as the gas blocking gripper 21, one expansion-restricting gripper 37 (comprising a pair of front and rear gripping elements) is provided for every pair of grippers 19, 19.

(1) In stop position I (bag-supplying station), the bag 11A equipped with gas compartment is supplied to the grippers 19, 19 from a conveyer magazine-type bag-supplying device 22, and as shown in FIG. 12 the grippers 19, 19 grip a predetermined location of the sealed portion 12 (external portion of the gas compartment portion 16) and a predetermined location of the sealed portion 13. The gas blocking gripper 21 and the expansion-restricting gripper 37 are both open. This state is illustrated in FIG. 13(*a*).

(2) A printing step, a mouth-opening step, and a filling step are carried out in stop positions II-IV, respectively. On the other hand, during this period, the expansion-restricting gripper 37 is closed at a predetermined moment in time, holding, between its opposed faces, the front and rear sides of the sealed portion 12 (this moment in time can be immediately before the start of the gas injection in the next stop position V). A gas compartment portion 16 is formed in the sealed portion 12, and the expansion-restricting gripper 37 holds the neck section 16*a* of the gas compartment portion 16 between its opposed faces of the gripping elements. The regions held by the expansion-restricting gripper 37 in the gas compartment portion 16 are located in the vicinity of the region gripped by the gas blocking gripper 21 (referred to as a "blockage region" in the present invention). In the present invention these regions are referred to as a "restriction region(s)." As shown in FIG. 13(*b*), an extremely narrow gap H is formed between the opposed faces 37A, 37A of the expansion-restricting gripper 37.

(3) In stop position V (gas filling station), the nozzle 28 and the bag backing member 29 advance forward, and the injection of the gas starts. As seen from FIG. 14(*a*), when the internal pressure in the gas compartment portion 16 increases as a result of the gas injection, and the gas compartment portion 16 starts to expand in the regions gripped by the expansion-restricting gripper 37 (the restriction regions); however, the expansion of the restriction regions is restricted by the opposed faces 37A, 37A of the expansion-restricting gripper 37, and the expanded shape of the gas compartment portion 16 in these regions or in their vicinity is restricted to a flat configuration. A space is created between the two film sheets 23 and 24 in the regions gripped by the expansion-restricting gripper 37 (the restriction regions), and the compressed gas flows therethrough into the gas compartment portion 16 below the restriction regions, thus making free expansion in response to the pressure of the gas. These actions are identical to those of the expansion-restricting gripper 36 described in Embodiment 2.

Subsequently, as shown in FIG. 14(*b*), the gas blocking gripper 21 closes and grips both sides of the blockage region configured between the transverse portions of the expansion-restricting gripper 37 (between the restriction regions), thereby blocking the fluid communication of the gas between the incision 17 and the interior of the gas compartment portion 16.

(4) A first sealing step, a second sealing step, and a seal cooling step are carried out in the stop positions VI-VIII, respectively, and a product packaged bag equipped with gas compartment is discharged from the apparatus. The expansion-restricting gripper 37 opens and releases the sealed portion 12 at an appropriate moment in time after the gas blocking gripper 21 is closed in stop position V and before the cooling plates 34 are opened in stop position VIII. In addition, the gas blocking gripper 21 is opened and releases the sealed portion 12 at an appropriate moment in time after the first sealing step and before the cooling plates 34 are opened in stop position VIII.

Embodiment 4

Figure 15B:
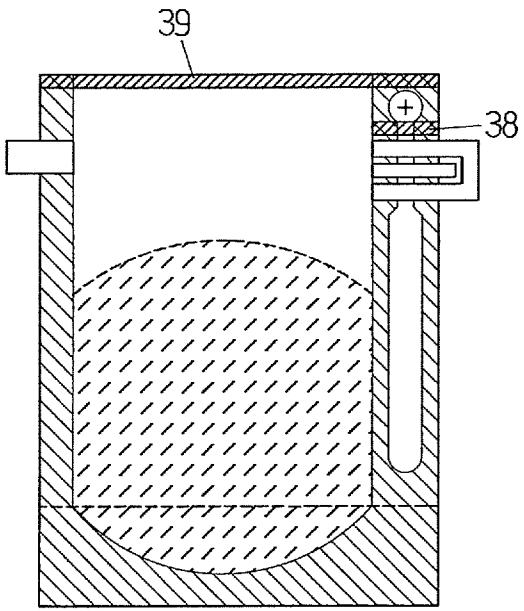
FIGS. 15(*a*) and 15(*b*) are front views for explaining yet another gas charging method of the present invention.
Figure 15A:
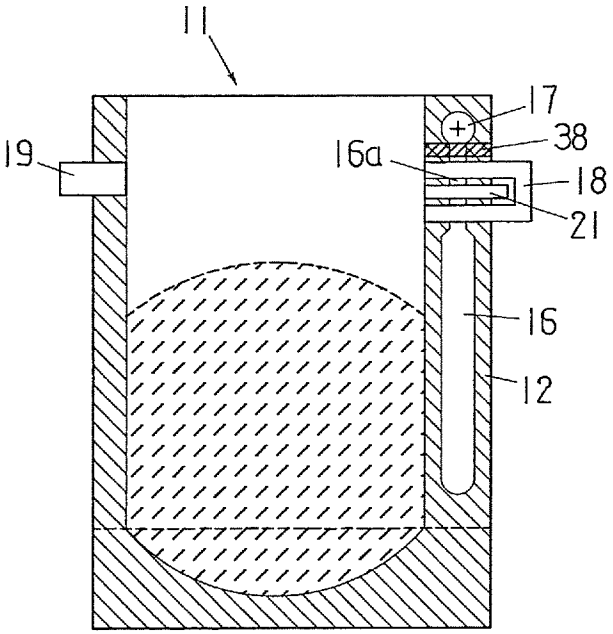

Still another gas charging method and apparatus of the present invention will be described with reference to FIGS. 15(*a*) and 15(*b*). In FIGS. 15(*a*) and 15(*b*), the same reference numerals are assigned to substantially the same regions and elements as those of the bag equipped with gas compartment and gas charging apparatus described in Embodiment 1.

In the gas charging method and apparatus described in Embodiment 1, the blockage region of the gas compartment portion 16 of the bag 11 equipped with gas compartment is gripped by the gas blocking gripper 21, thus blocking the fluid communication of the gas between the incision 17 and the interior of the gas compartment portion 16, and then the mouth of the bag 11, including the incision 17, is clamped by the hot plates so as to seal the incision 17 together with the mouth of the bag while the blocked state is being maintained, thus entrapping the gas in the interior of the gas compartment portion 16. However, in Embodiment 4, a location directly underneath the incision 17 is clamped by hot plates when the gas compartment portion 16 is charged (or filled) with a gas.

The gas charging method of Embodiment 4 will be described with reference to FIGS. 15(*a*) and 15(*b*) in a manner similar to the description provided for Embodiment 1.

(1) In stop positions I-V, a bag-supplying step, a printing step, a mouth-opening step, a filling step, and a gas filling step are carried out in a consecutive manner similar to Embodiment 1 (see FIG. 6(*a*), FIG. 6(*b*), etc.).

(2) In stop position VI (first sealing station), a first sealing device (including a pair of hot plates) is provided which is used for sealing the gas compartment portion 16 (more specifically, the neck section 16*a*) at a location directly underneath the incision 17. As shown in FIG. 15(*a*), when the bag 11 gripped by the bag-conveying grippers 18 and 19 stops in this stop position VI, hot plates (not shown) clamp and seal both sides of the location underneath the incision 17 in a horizontal configuration spanning across the same location (sealed portion 38), and then the gas compartment portion 16 is charged with a gas.

(3) In stop position VII (second sealing station), a second sealing device (comprising a pair of hot plates) is provided which is used for sealing the mouth of the bag. As shown in FIG. 15(*b*), when the bag 11 equipped with gas compartment stops in this stop position VII, hot plates (not shown) clamp and seal both sides of the bag mouth (sealed portion 39), thus hermetically enclosing the contents for the bag inside the bag 11. At such time, if necessary, the location of the incision 17 can also be sealed. Alternatively, a separate step for sealing the incision 17 can also be provided.

(4) In stop position VIII, a seal cooling device (including a pair of cooling plates) is provided which is used for cooling the sealed portion 39. When the bag 11 equipped with gas compartment stops in this stop position VIII, the cooling plates (not shown) clamp and cool the sealed portion 39; and while the cooling step is in progress, the gas blocking gripper 21 and bag-conveying grippers 18 and 19 are opened, and the cooling plates are opened as well, discharging a bag 11P equipped with gas compartment (a product packaged bag equipped with gas compartment) from the apparatus. The gas blocking gripper 21 can be opened at the stage when the first sealing step is completed.

Embodiment 5

Figure 16C:
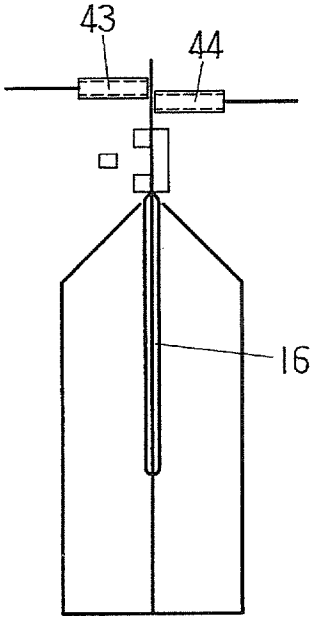
FIGS. 16(*a*) through 16(*c*) are side views that illustrate a step-by-step explanation of still another gas charging method (and packaging method) of the present invention.
Figure 16B:
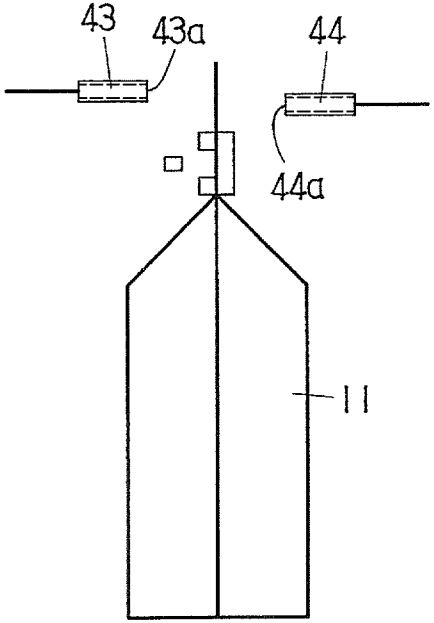
Figure 16A:
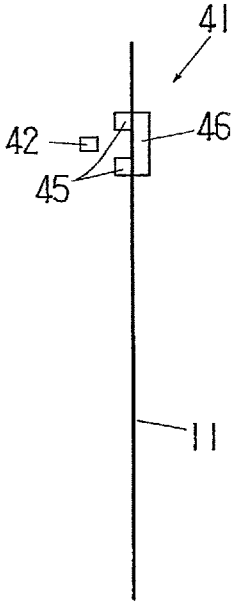

Next, still another gas charging method and apparatus of the present invention will be described with reference to FIGS. 16(*a*) through 21(*b*). In FIGS. 16(*a*) through 21(*b*), the same reference numerals are assigned to substantially the same regions and elements as those of the bag equipped with gas compartment and gas charging apparatus described in Embodiment 1.

In Embodiment 5, a bag-conveying gripper 41 is used instead of the bag-conveying gripper 18 used in Embodiment 1, and a gas blocking gripper 42, along with a portion (a gripping element 46 described below) of the bag-conveying gripper 41, is used instead of the gas blocking gripper 21. In addition, a pair of gas injection nozzles 43 and 44 is, as the gas filling means, used instead of the gas injection nozzle 28 and bag backing member 29 used in Embodiment 1. Furthermore, while the bag 11 equipped with gas compartment described in Embodiment 1 is used as the bag equipped with gas compartment in Embodiment 5, the incision 17 in the gas compartment portion 16 is formed in the front and rear film sheets 23 and 24.

The bag-conveying gripper 41 includes a pair of gripping elements 45 and 46. The gripping element 45, in the same manner as the bag-conveying gripper 18 used in Embodiment 1, is shaped substantially like the letter "U" turned on its side when viewed from the front (see FIG. 19(*b*)); and the gripping element 46, on the other hand, has a substantially quadrangular shape when viewed from the front, and its outline practically coincides with the contour of the gripping element 45. The bag-conveying gripper 41 grips the front and rear sides of the sealed side edge portion 12, in which the gas compartment portion 16 is formed, with the gripping element 46 and the top and bottom transverse portions 45*a* and 45*b* of the gripping element 45. A groove 47 extending in the vertical direction is formed in each of the gripping surfaces 45A (opposed faces) of the top and bottom transverse portions 45*a* and 45*b* of the gripping element 45 (see FIG. 19(*b*)). The groove 47 is, as seen from FIG. 20(*a*), shallow in terms of the thickness direction of the transverse portions 45*a* and 45*b* or in terms of the horizontal direction. No grooves are formed in the gripping surfaces (opposed faces) of the gripping element 46, and thus the gripping surfaces of the gripping element 46 are substantially flat. The region gripped by the bag-conveying gripper 41 is the location where a neck section 16*a* is provided in the gas compartment portion 16, and the top and bottom transverse portions 45*a* and 45*b* of the gripping element 45, as well as the gripping element 46, grip the neck section 16*a* in the vicinity of the incision 17 in a horizontally spanning configuration. However, when closed, the bag-conveying gripper 41 is in a position in which the bag-conveying gripper 41 holds the neck section 16*a* at its grooves 47 of its opposed faces. The gap J, as seen from FIG. 20(*a*), between the two opposed faces 45A and 46A of the gripping elements 45 and 46 in the neck section 16*a* is wider than the thickness of the film of the gas compartment portion 16 only by the depth of the grooves 47. In other words, when the bag-conveying gripper 41 is closed, the gripping elements 45 and 46 only hold the neck section 16*a* between the two opposed faces 45A and 46A of its gripping elements while they are being mutually spaced apart from each other for a predetermined distance J in between, and the gripping elements 45 and 46 do not grip the neck section 16*a*.

The other sealed side edge portion 13 of the bag 11 is gripped by a regular bag-conveying gripper 19 (not shown).

The gas blocking gripper 42 is provided so as to face the gripping element 46 of the bag-conveying gripper 41. When closed, the front and rear sides of the sealed side edge portion 12, in which the gas compartment portion 16 is formed, are gripped between the gas blocking gripper 42 and the gripping surface (opposed surface) 46A of the gripping element 46. In this manner, the gripping element 46 of the bag-conveying gripper 41 serves double duty as a gas blocking gripper. When closed, the gas blocking gripper 42 and the gripping element 46 grip the neck section 16*a* in a horizontally spanning configuration between the gripping elements 45 and 46.

Figure 19A:
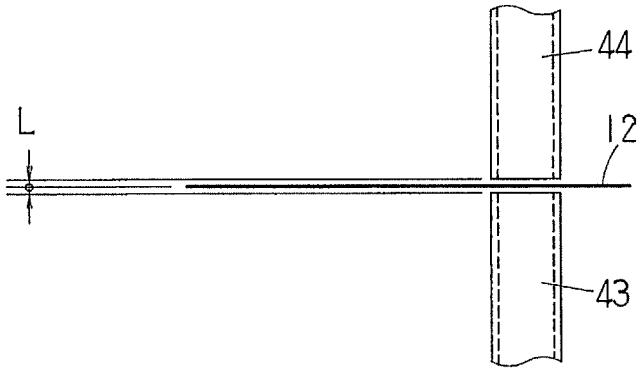
FIGS. 19(*a*) and 19(*b*) are enlarged diagrams illustrating the gas charging method, wherein FIG. 19(*a*) is a top view of the main elements working during the injection of the gas, and FIG. 19(*b*) is a front view of the main elements during the injection of the gas.
Figure 19B:
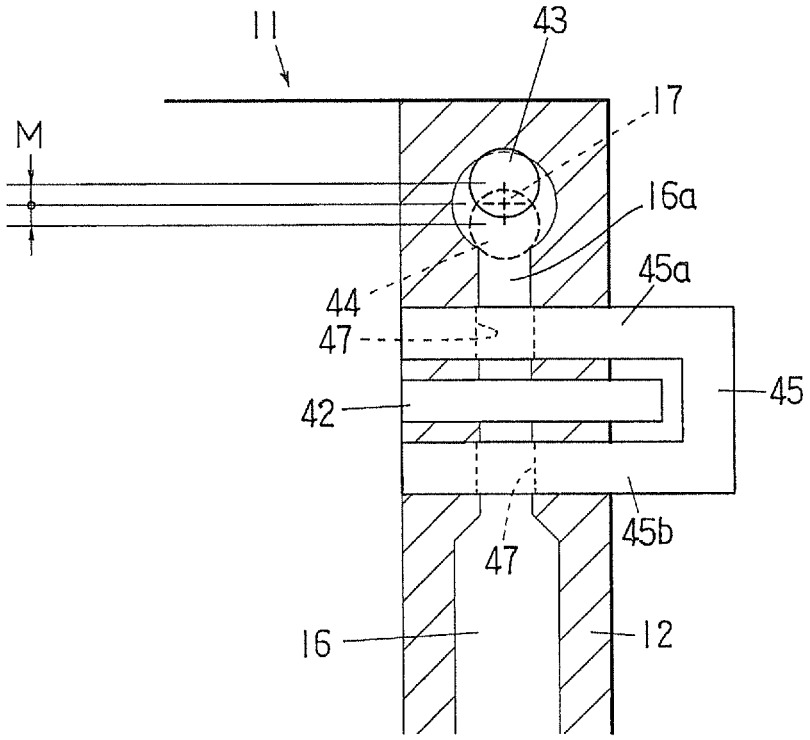

The nozzles 43 and 44 advance towards or retreat from the bag 11 equipped with gas compartment. In advanced positions thereof, the discharge openings 43*a* and 44*a* at the distal ends thereof are aligned with the incisions 17 formed in the front and rear film sheets 23 and 24 of the gas compartment portion 16 of the bag 11. When the nozzles 43 and 44 are positioned in their advanced positions, as shown in FIG. 19(*a*), a predetermined gap L, which is slightly wider than the thickness of the film sheets 23 and 24, is provided between the two discharge openings 43*a* and 44*a*, and this gap L does not change until the nozzles 43 and 44 retreat from the advanced positions. As a result of the gap L between two discharge openings 43*a* and 44*a*, a space is formed between the film sheets 23 and 24 during the gas discharge.

In addition, the inner diameter of the discharge openings 43*a* and 44*a* of the nozzles 43 and 44 is set smaller than the diameter of the gas compartment portion 16 in the location, in which the incision 17 is formed; and in addition, in the advanced positions of the nozzles 43 and 44, the centers of the discharge openings 43*a* and 44*a* are set so that there is a vertical shift by a distance M between them in the vertical direction (see FIG. 19(*b*)).

The gas charging method of Embodiment 5 will be described with reference to FIGS. 16(*a*) through 21(*b*) in a manner similar to the description provided for Embodiment 1.

Figure 20B:
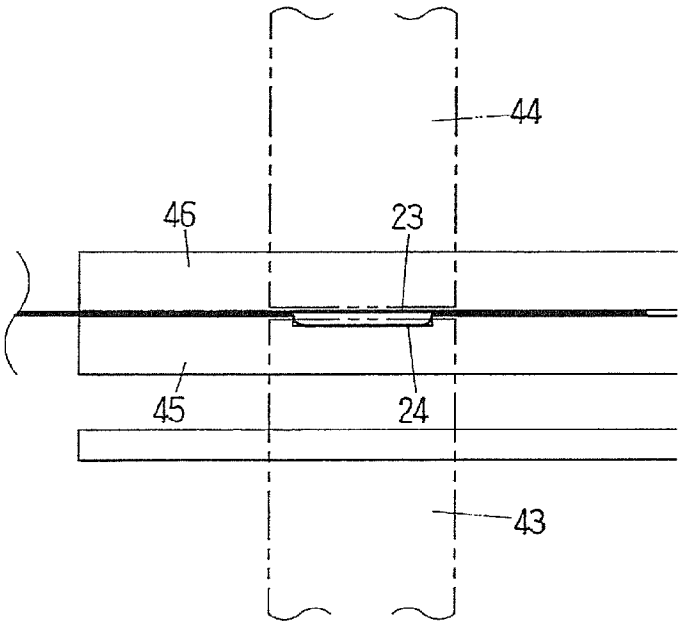
FIGS. 20(*a*) and 20(*b*) are enlarged horizontal cross-sectional views of the main elements working in the gas charging method, wherein FIG. 20(*a*) shows a state before the injection of the gas, and FIG. 20(*b*) shows a state after the start of the gas injection.
Figure 20A:
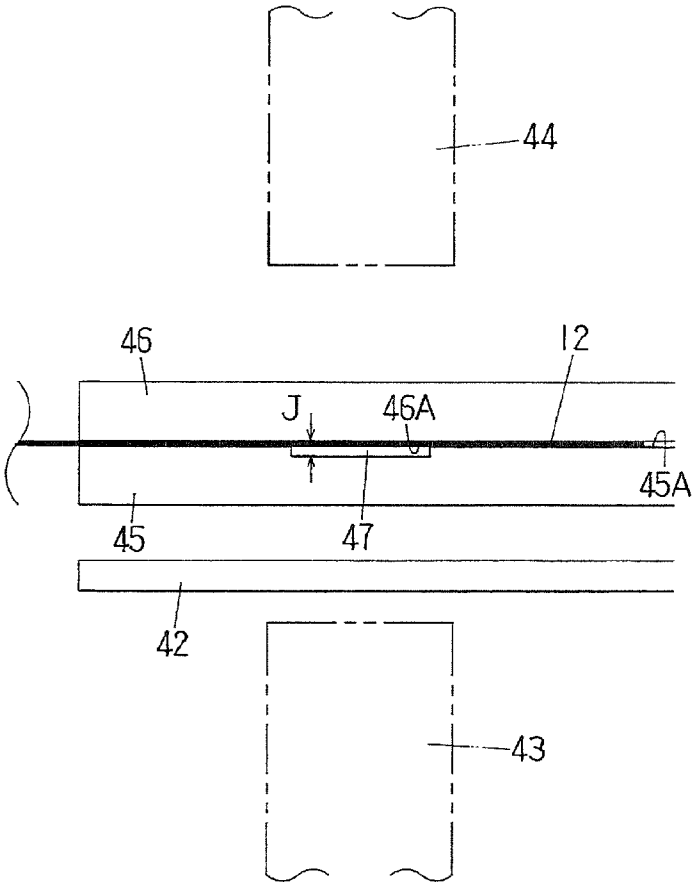

(1) In stop position I (bag-supplying station), a bag 11 equipped with gas compartment is supplied to the grippers 41 and 19 from a conveyer magazine-type bag-supplying device 22; and as shown in FIG. 16(*a*), the gripper 41 grips a predetermined location of the sealed portion 12, and the gripper 19 grips a predetermined location of the sealed portion 13 (neither gripper 19 nor sealed portion 13 are shown in FIG. 16(*a*)). As shown in FIG. 20(*a*), a gap J is provided, in accordance with the groove 47, between the two opposed faces 45A and 46A of the gripping elements 45 and 46 that hold the neck section 16*a* of the gas compartment portion 16 of the bag. The region held by the gripper 41 (more specifically by the gripping elements 45 and 46) in the neck section 16*a* is located in the vicinity of the region gripped by the gas blocking gripper 42 (and gripping element 46) (referred to as a "blockage region"). In the present invention, this region is referred to as a "restriction region(s)."

(2) A printing step, a mouth-opening step, and a filling step are carried out in stop positions II-IV, respectively.

(3) As seen from FIGS. 16(*b*) and 16(*c*), in stop position V (gas filling station), the nozzles 43 and 44 advance forward, and the injection of the gas starts. Before the start of the gas injection, the discharge openings 43*a* and 44*a* of the nozzles 43 and 44 remain spaced away from the film sheets 23 and 24 of the gas compartment portion 16; and when the injection of the gas from the two nozzles 43 and 44 starts, the gas compartment portion 16 expands in the area of the incisions 17 formed in the two film sheets 23 and 24 and in the vicinity thereof, and the film sheets 23 and 24, respectively, adhere to the discharge openings 43*a* and 44*a* of the nozzles 43 and 44. Gas is thus efficiently injected into the gas compartment portion 16 through the incisions 17 formed in the two film sheets 23 and 24.

As shown in FIG. 20(*b*), when the internal pressure in the gas compartment portion 16 increases as a result of the gas injection and the gas compartment portion 16 starts to expand or inflate in the regions gripped by the gripping elements 45 and 46 (the restriction regions) of the neck section 16*a*, the expansion of the restriction regions is restricted by the opposed faces 45A and 46A of the gripping elements 45 and 46, and the expanded shape of the gas compartment portion 16 in these regions or in their vicinity is restricted to a flat configuration. The gas injected into the gas compartment portion 16 flows downward through the space between the two film sheets 23 and 24 in the restriction regions, and the gas compartment portion 16 underneath the restriction regions freely expands in response to the pressure of the gas.

Figure 17C:
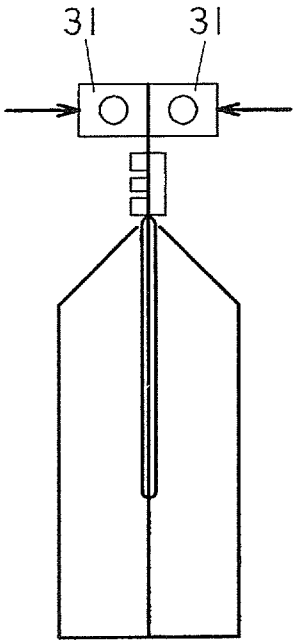
FIGS. 17(*a*) through 17(*c*) are side views that illustrate a step-by-step explanation of the subsequent steps.
Figure 17B:
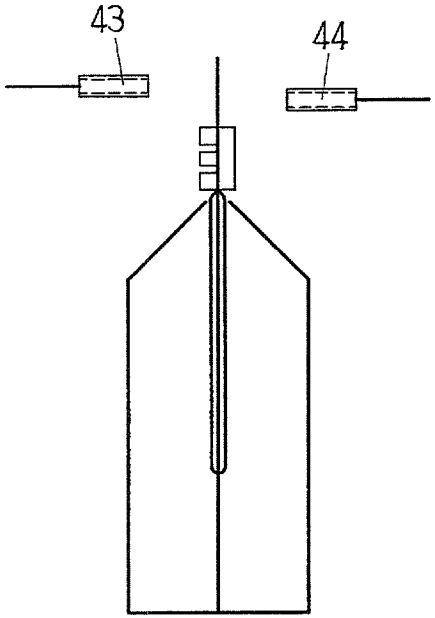
Figure 17A:
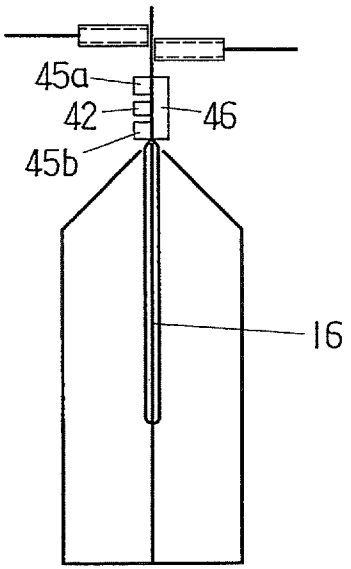
Figure 21B:
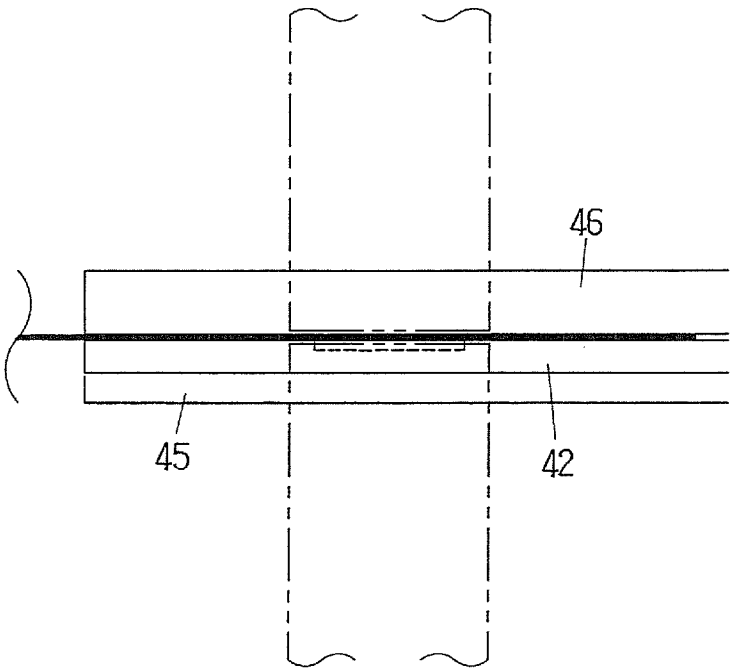
FIGS. 21(*a*) and 21(*b*) are enlarged horizontal cross-sectional views of the main elements working in the gas charging method, wherein FIG. 21(*a*) shows a state before the bag is gripped by the gas blocking gripper, and FIG. 21(*b*) shows a state after the bag has been gripped.
Figure 21A:
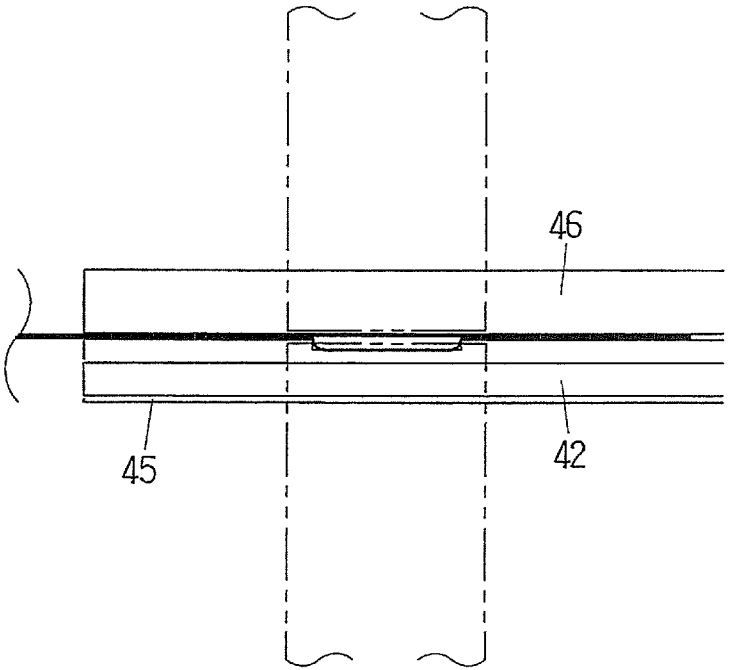

Subsequently, as shown in FIG. 17(*a*) and FIGS. 21(*a*) and 21(*b*), the gas blocking gripper 42 closes and grips both sides of the blockage region configured between the transverse portions 45*a* and 45*b* of the gripping element 45 (between the restriction regions), thus blocking the fluid communication of the gas between the incision 17 and the interior of the gas compartment portion 16. Subsequently, as shown in FIG. 17(*b*), the nozzles 43 and 44 retreat to the standby positions.

(4) A first sealing step (see FIG. 17(*c*)) and a second sealing step are carried out in stop positions VI-VII, respectively.

Figure 18A:
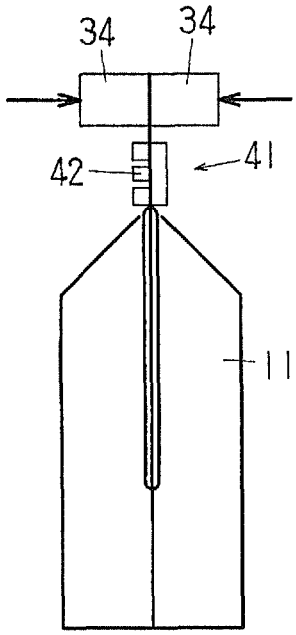
FIGS. 18(*a*) and 18(*b*) are side views that illustrate a step-by-step explanation of the further subsequent steps.
Figure 18B:
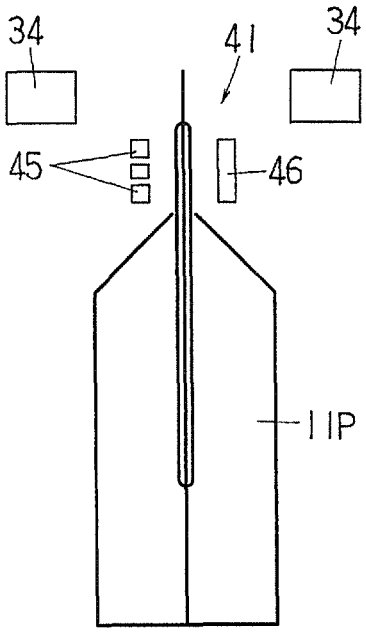

(5) In stop position VIII, a seal cooling step (see FIG. 18(*a*)) is carried out. Subsequently, while the cooling operation is in progress, the gas blocking gripper 42 and the bag-conveying grippers 41 and 19 are opened (the bag-conveying gripper 19 is not shown), and in addition the cooling plates 34 are opened (see FIG. 18(*b*)) as well, dropping a bag 11*p* equipped with gas compartment (or a product packaged bag equipped with gas compartment) and discharging it from the apparatus through a chute 35. The gas blocking gripper 42 can be opened at the stage when the first sealing step or second sealing step ends.

The present invention is described above with reference to Embodiments 1-5, and still further embodiments can be provided by the present invention as follows:

(1) In the above description, the bag-conveying gripper 18, the gripping elements 45 of the bag-conveying gripper 41, and the expansion-restricting grippers 36 and 37 are all shaped like the letter "U" turned on its side when viewed from the front; and the top and bottom transverse portions grip the sealed portion 12 (in particular, the neck section 16*a*) in two, top and bottom, locations, or the sealed portion is held between the opposed faces with gaps H, J therebetween. In addition, the blockage region gripped by the gas blocking grippers 21 and 42 is configured between the top and bottom transverse portions (between the restriction regions). However, in the present invention, only one, single restriction region can be provided. In other words, as long as the restriction region is gripped by the bag-conveying gripper 18, the gripping elements 45 of the bag-conveying gripper 41, and the expansion-restricting grippers 36 and 37, or is held between the opposed faces with gaps H, J therebetween, is located in the vicinity of the blockage region, such a region can be provided in just one location in the sealed portion 12 (in particular, in the neck section 16*a*).

(2) In the description above, the incision 17 is provided in the upper end area of the gas compartment portion of the bag 11 and 11A equipped with gas compartments. Instead of the incision, an opening (or a gas inlet) can be formed in association with the gas compartment portion.

(3) The groove 47 formed in the gripping elements 45 of the bag-conveying gripper 41 in Embodiment 5 can also be applied to the expansion-restricting grippers 36 and 37.

The invention claimed is:

1. A method for charging a bag equipped with a gas compartment with a gas, wherein said method uses a bag equipped with a gas compartment, the bag being formed integrally therewith a gas compartment portion extending in a longitudinal direction in a sealed side edge portion of the bag and formed with a gas inlet which is for placing an exterior of the bag in communication with an interior of the gas compartment portion and is provided in a vicinity of the bag mouth in a surface of a film that makes the gas compartment portion, and said method comprises:

holding the bag in a suspended state by gripping two lateral edges of the bag equipped with the gas compartment with a pair of left and right bag-conveying grippers, continuously or intermittently conveying the bag along a predetermined conveying path, and while the bag is being conveyed, accomplishing charging of the gas compartment portion with a gas by:

aligning a discharge outlet of a nozzle connected to a pressurized gas supply source with the gas inlet, injecting gas from the nozzle into the gas compartment portion through the gas inlet, and, while the injection is in progress, gripping a blockage region configured in a vicinity of the gas inlet with a gas blocking gripper to thereby block fluid communication of the gas between the gas inlet and the interior of the gas compartment portion, and then, while maintaining the blocked state, gripping both sides of the bag in a location of the gas inlet or in a location in the vicinity of the gas inlet with hot plates to seal the gas inlet or the location in the vicinity of the gas inlet, and wherein one of said bag-conveying grippers grips a restriction region configured in a vicinity of the blockage region from both sides of the bag, and a gap between opposed faces of said one of said bag-conveying grippers at a time of the gripping is set to be wider than a thickness of the film of the gas compartment portion in the restriction region, so that the gas flows through the restriction region during the injection of the gas, and an expanded shape of the restriction region is restricted to a flat configuration.

2. The method for charging a bag equipped with a gas compartment with a gas according to claim 1, wherein a groove is provided in said one of said bag-conveying grippers in a location where the opposed faces of said one of said bag-conveying grippers hold the restriction region between the opposed faces.

3. The method for charging a bag equipped with a gas compartment with a gas according to claim 1, wherein the gas inlet is provided in an upper end area of the gas compartment portion, and the vicinity of the gas inlet is configured directly underneath the gas inlet.

4. A method for charging a bag equipped with a gas compartment with a gas, wherein said method uses a bag equipped with a gas compartment, the bag being formed integrally therewith a gas compartment portion extending in a longitudinal direction in a sealed side edge portion of the bag and formed with a gas inlet which is for placing an exterior of the bag in communication with an interior of the gas compartment portion and is provided in a surface of a film that makes the gas compartment portion, and said method charges the gas compartment portion with a gas by:

aligning a discharge outlet of a nozzle connected to a pressurized gas supply source with the gas inlet, injecting gas from the nozzle into the gas compartment portion through the gas inlet, while the injection is in progress, gripping a blockage region configured in a vicinity of the gas inlet with a gas blocking gripper on both sides of the bag to thereby block fluid communication of the gas between the gas inlet and the interior of the gas compartment portion, and then, while maintaining the blocked state, gripping both sides of the bag in a location of the gas inlet or in a location in the vicinity of the gas inlet with hot plates to seal the gas inlet or the location in the vicinity of the gas inlet, wherein during the injection of the gas into the gas compartment portion, said method restricts, from both sides of the bag, expansion between front and rear film surfaces of the bag in a restriction region configured in a vicinity of the blockage region, so that an expanded shape of the restriction region is restricted to a flat configuration, and wherein the restriction region is configured in two locations above and below the blockage region.

5. A method for charging a bag equipped with a gas compartment with a gas, wherein said method uses a bag equipped with a gas compartment, the bag being formed integrally therewith a gas compartment portion extending in a longitudinal direction in a sealed side edge portion of the bag and formed with a gas inlet which is for placing an exterior of the bag in communication with an interior of the gas compartment portion and is provided in a surface of a film that makes the gas compartment portion, and said method charges the gas compartment portion with a gas by:

aligning a discharge outlet of a nozzle connected to a pressurized gas supply source with the gas inlet, injecting gas from the nozzle into the gas compartment portion through the gas inlet, while the injection is in progress, gripping a blockage region configured in a vicinity of the gas inlet with a gas blocking gripper on both sides of the bag to thereby block fluid communication of the gas between the gas inlet and the interior of the gas compartment portion, and then, while maintaining the blocked state, gripping both sides of the bag in a location of the gas inlet or in a location in the vicinity of the gas inlet with hot plates to seal the gas inlet or the location in the vicinity of the gas inlet, wherein during the injection of the gas into the gas compartment portion, said method restricts, from both sides of the bag, expansion of a restriction region configured in a vicinity of the blockage region, so that an expanded shape of the restriction region is restricted to a flat configuration, and wherein the restriction region is configured in two locations above and below the blockage region.

* * * * *